US010690426B1

(12) United States Patent
Huang

(10) Patent No.: US 10,690,426 B1
(45) Date of Patent: Jun. 23, 2020

(54) MAGAZINE RELEASE BUTTON ASSEMBLY

(71) Applicant: George Huang, Henderson, NV (US)

(72) Inventor: George Huang, Henderson, NV (US)

(73) Assignee: Battlearms IP, LLC, Henderson, NV (US)

( * ) Notice: Subject to any disclaimer, the term of this patent is extended or adjusted under 35 U.S.C. 154(b) by 0 days.

(21) Appl. No.: 16/238,617

(22) Filed: Jan. 3, 2019

Related U.S. Application Data

(63) Continuation of application No. 15/375,223, filed on Dec. 12, 2016, now abandoned, which is a continuation-in-part of application No. 14/561,209, filed on Dec. 4, 2014, now Pat. No. 9,518,792.

(51) Int. Cl.
*F41A 35/00* (2006.01)
*F41C 27/00* (2006.01)
*F41A 9/59* (2006.01)

(52) U.S. Cl.
CPC ..... *F41A 9/59* (2013.01); *F41A 35/00* (2013.01); *F41C 27/00* (2013.01)

(58) Field of Classification Search
CPC ..... F41A 29/00; F41A 35/00; F41A 11/00; F41A 17/56; F41A 17/64; F41A 17/74; F41A 19/11; F41A 35/06; F41A 17/38; F41A 3/66; F41C 27/00; F41G 1/545
USPC ..... 42/6
See application file for complete search history.

(56) References Cited

U.S. PATENT DOCUMENTS 3,442,173 A * 5/1969 Muller ..... F41A 19/46 89/127
5,519,954 A * 5/1996 Garrett ..... F41A 17/38 42/6
7,444,775 B1 * 11/2008 Schuetz ..... F41A 9/71 42/49.02
8,112,926 B2 * 2/2012 Gussalli Beretta ..... F41A 17/38 42/6
8,276,502 B1 * 10/2012 Wright ..... F41A 17/46 42/70.01
8,468,929 B2 * 6/2013 Larson ..... F41A 5/28 89/191.01
8,756,847 B2 * 6/2014 Huther ..... F41A 17/74 42/70.01
8,806,790 B1 * 8/2014 Huang ..... F41A 17/74 42/70.08

(Continued)

OTHER PUBLICATIONS

Officer960, "Manticore Arms Products Review", Forum Thread on AR-15.com, <https://www.ar15.com/forums/armory/MANTICORE_ARMS_Products_Review/45-384269/>, Nov. 25, 2012, Entire Thread. (Year: 2012).*

*Primary Examiner* — Jonathan C Weber
(74) *Attorney, Agent, or Firm* — Shaddock Law Group, PC

(57) ABSTRACT

A magazine release button assembly for a firearm, including at least some of a button member, wherein the button member includes a projection extending from an end of the button member, and wherein the projection comprises a dovetail projection; and a finger pad member, wherein the finger pad member includes a recess, wherein the recess comprises a dovetail recess, wherein the dovetail recess is mateable with the dovetail projection of the button member, and wherein the finger pad member is secured to the end of the button member via interaction of the dovetail projection and the dovetail recess.

11 Claims, 34 Drawing Sheets

(56) References Cited

U.S. PATENT DOCUMENTS

| | | | | |
|---|---|---|---|---|
| 9,010,004 | B1 * | 4/2015 | Fu | F41A 17/38<br>42/49.01 |
| 2006/0123683 | A1 * | 6/2006 | Garrett | F41A 17/38<br>42/6 |
| 2007/0180984 | A1 * | 8/2007 | Huther | F41A 17/74<br>89/148 |
| 2010/0263252 | A1 * | 10/2010 | Strayer | F41A 17/38<br>42/7 |
| 2011/0271827 | A1 * | 11/2011 | Larson | F41A 5/28<br>89/193 |

* cited by examiner

MAGAZINE RELEASE BUTTON ASSEMBLY

CROSS-REFERENCE TO RELATED APPLICATIONS

This patent application is a Continuation of co-pending U.S. patent application Ser. No. 15/375,223, filed Dec. 12, 2016, which is a Continuation-In-Part of co-pending U.S. patent application Ser. No. 14/561,209, filed Dec. 4, 2014, now U.S. Pat. No. 9,518,792, the disclosure of which is incorporated herein in its entirety by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of firearms. More specifically, the present disclosure relates to a magazine release button assembly adaptable to be used with a firearm, such as the AR-15, M4, and the like.

2. Description of Related Art

The AR-15 is based on the AR-10, which was designed by Eugene Stoner, Robert Fremont, and L. James Sullivan of the Fairchild ArmaLite corporation in 1957. Today, there are numerous variants of the AR-15 that are manufactured by a number of companies. The AR-15 and its various related derivative platforms are used by civilians, law enforcement personnel, and military forces around the world.

Various firearms, such as, for example, the AR-15 or M-4 style firearms 10, as illustrated in FIG. 1, include a push-button magazine release found on one side of the firearm. Ofttimes, as further illustrated in FIGS. 1-4, the magazine release button 11 is at least partially protected by one or more ridges that reduce the chances of inadvertent activation.

The magazine release button 11 typically includes an internal, aperture 12 that extends through the entire magazine release button 11. The magazine release mechanism typically includes a magazine release button 11 that is coupled to a magazine release 20, which includes a magazine engagement projection 23 that releasably engages a portion of a magazine, when fully inserted within the magazine well of the firearm 10.

The magazine release 20 includes a magazine release connection shaft 21 that extends from one side of the magazine release. The magazine release connection shaft 21 includes a threaded portion 22 that can be threaded late engaged with the aperture 12 of the magazine release button 11.

A magazine release spring 15 typically provides spring biasing to the magazine release lever 11, when installed in the firearm 10.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, the typical magazine release button arrangement has various disadvantages and shortcomings. The disadvantages and shortcomings of the prior art are overcome by the features and elements of the magazine release button assembly of the present disclosure. The advantages of the present disclosure are preferably attained by providing a magazine release button assembly that comprises a button member and a finger pad member. The finger pad member is slidably, releasably attached to the button member so as to provide a more ergonomic magazine release button that provides more surface area and is more functional for user.

In various exemplary, non-limiting embodiments, the present disclosure comprises a magazine release button assembly having a button member, wherein the button member includes a projection formed on an end of the button member; and a finger pad member, wherein the finger pad member includes a recess mateable with the projection of the button member, wherein the finger pad member is secured to the end of the button member via interaction of the projection and the recess and is further secured to the end of the button member via a fastener.

In other exemplary, non-limiting embodiments, the present disclosure comprises a magazine release button assembly having a button member, wherein the button member includes a primary threaded aperture formed through the button member and a secondary aperture formed at least partially through the button member, wherein the secondary aperture is formed at a distance spaced apart from the primary threaded aperture, and wherein the button member includes a projection formed on an end of the button member; and a finger pad member, wherein the finger pad member includes a recess mateable with the projection of the button member, wherein the finger pad member further comprises a finger pad member aperture formed therethrough, wherein when the finger pad member is secured to the end of the button member, via interaction of the projection and the recess, the finger pad member aperture aligns with the secondary aperture, such that the finger pad member may be further secured to the end of the button member via a fastener secured through the finger pad member aperture and the secondary aperture.

In still other exemplary, non-limiting embodiments, the present disclosure comprises a magazine release button assembly having a button member, wherein the button member includes a primary threaded aperture formed through the button member and a secondary aperture formed at least partially through the button member, wherein the secondary aperture is formed at a distance spaced apart from the primary threaded aperture, and wherein the button member includes a dovetail projection formed on an end of the button member; and a finger pad member, wherein the finger pad member includes a dovetail recess mateable with the projection of the button member, wherein the finger pad member further comprises a finger pad member aperture formed therethrough, wherein when the finger pad member is secured to the end of the button member, via interaction of the dovetail projection and the dovetail recess, the finger pad member aperture aligns with the secondary aperture, such that the finger pad member may be further secured to the end of the button member via a fastener secured through the finger pad member aperture and the secondary aperture.

In various exemplary, nonlimiting embodiments, the magazine release button assembly of the present disclosure comprises a button member, wherein the button member includes a projection extending from an end of the button member, and wherein the projection comprises a dovetail projection; and a finger pad member, wherein the finger pad member includes a recess, wherein the recess comprises a dovetail recess, wherein the dovetail recess is mateable with the dovetail projection of the button member, and wherein the finger pad member is secured to the end of the button member via interaction of the dovetail projection and the dovetail recess.

In various exemplary, nonlimiting embodiments, the magazine release button assembly of the present disclosure further comprising a primary threaded aperture formed through the button member, parallel to the longitudinal axis of the button member, wherein the primary threaded aperture is formed so as to interact with a threaded portion of a magazine release.

In various exemplary, nonlimiting embodiments, the magazine release button assembly of the present disclosure further comprising a secondary aperture formed at least partially through the button member, wherein the secondary aperture is formed at a distance spaced apart from the primary threaded aperture, and wherein the secondary aperture is formed parallel to the longitudinal axis of the button member.

In various exemplary, nonlimiting embodiments, the magazine release button assembly of the present disclosure wherein the finger pad member further comprises a finger pad member aperture formed therethrough, wherein when the finger pad member is secured to the button member, the finger pad member aperture aligns with the secondary aperture, such that a fastener can be secured through the finger pad member aperture and the secondary aperture.

In various exemplary, nonlimiting embodiments, the magazine release button assembly of the present disclosure wherein the button member is shaped so as to resist rotational movement and allow at least some movement along a longitudinal axis of the button member.

In various exemplary, nonlimiting embodiments, the magazine release button assembly of the present disclosure wherein the finger pad member is further secured to the end of the button member via a fastener.

In various exemplary, nonlimiting embodiments, the magazine release button assembly of the present disclosure wherein the fastener comprises a spring biased ball and the secondary aperture comprises a ball detent.

In various exemplary, nonlimiting embodiments, the magazine release button assembly of the present disclosure wherein the finger pad member comprises a substantially concave, flat, or convex surface.

In various exemplary, nonlimiting embodiments, the magazine release button assembly of the present disclosure wherein a plurality of parallel grooves are formed on a surface of the finger pad member.

In various exemplary, nonlimiting embodiments, the magazine release button assembly of the present disclosure wherein a plurality of interchangeable finger pad members are provided.

In various exemplary, nonlimiting embodiments, the magazine release button assembly of the present disclosure comprises a button member, wherein the button member includes a primary threaded aperture formed through the button member, and wherein the button member includes a projection extending from an end of the button member; and a finger pad member, wherein the finger pad member includes a recess mateable with the projection of the button member.

In various exemplary, nonlimiting embodiments, the magazine release button assembly of the present disclosure wherein the button member is shaped so as to resist rotational movement and allow at least some movement along a longitudinal axis of the button member.

In various exemplary, nonlimiting embodiments, the magazine release button assembly of the present disclosure wherein the projection comprises a dovetail projection and the recess in the finger pad member comprises a dovetailed recess.

In various exemplary, nonlimiting embodiments, the magazine release button assembly of the present disclosure wherein the button member includes a secondary aperture formed at least partially through the button member, wherein the secondary aperture is formed at a distance spaced apart from the primary threaded aperture, wherein the finger pad member further comprises a finger pad member aperture formed therethrough, wherein when the finger pad member is secured to the end of the button member, via interaction of the projection and the recess, the finger pad member aperture aligns with the secondary aperture, such that the finger pad member may be further secured to the end of the button member via a fastener secured through the finger pad member aperture and the secondary aperture.

In various exemplary, nonlimiting embodiments, the magazine release button assembly of the present disclosure wherein the finger pad member comprises a substantially concave surface.

In various exemplary, nonlimiting embodiments, the magazine release button assembly of the present disclosure wherein the finger pad member is secured to the end of the button member via interaction of the projection and the recess.

In various exemplary, nonlimiting embodiments, the magazine release button assembly of the present disclosure comprises a button member, wherein the button member includes a primary threaded aperture formed through the button member, and wherein the button member includes a recess formed in at least a portion of an end of the button member; and a finger pad member, wherein the finger pad member includes a projection extending from an end of the finger pad member, and wherein the projection is mateable with the recess of the button member.

In various exemplary, nonlimiting embodiments, the magazine release button assembly of the present disclosure wherein the projection is a dovetail projection and the recess is a dovetail recess.

In various exemplary, nonlimiting embodiments, the magazine release button assembly of the present disclosure wherein the button member is shaped so as to resist rotational movement and allow at least some movement along a longitudinal axis of the button member.

In various exemplary, nonlimiting embodiments, the magazine release button assembly of the present disclosure wherein the button member includes a secondary aperture formed at least partially through the button member, wherein the secondary aperture is formed at a distance spaced apart from the primary threaded aperture, wherein the finger pad member further comprises a finger pad member aperture formed therethrough, wherein when the finger pad member is secured to the end of the button member, via interaction of the recess and the projection, the finger pad member aperture aligns with the secondary aperture, such that the finger pad member may be further secured to the end of the button member via a fastener secured through the finger pad member aperture and the secondary aperture.

Accordingly, the present disclosure separately provides improved magazine release buttons for firearms.

The present disclosure separately provides improved magazine release buttons for firearms, which finger pad members are interchangeable.

The present disclosure separately provides improved magazine release buttons for firearms, which finger pad members provide an increased surface area for a user's finger to contact.

The present disclosure separately provides improved magazine release buttons for firearms, which finger pad members provide an increased surface area for a user's finger to contact.

The present disclosure separately provides improved magazine release buttons for firearms, which finger pad member provides better purchase of a user's finger on the surface of the finger pad member.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the present disclosure discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF THE PRESENT DISCLOSURE

Figure 1:
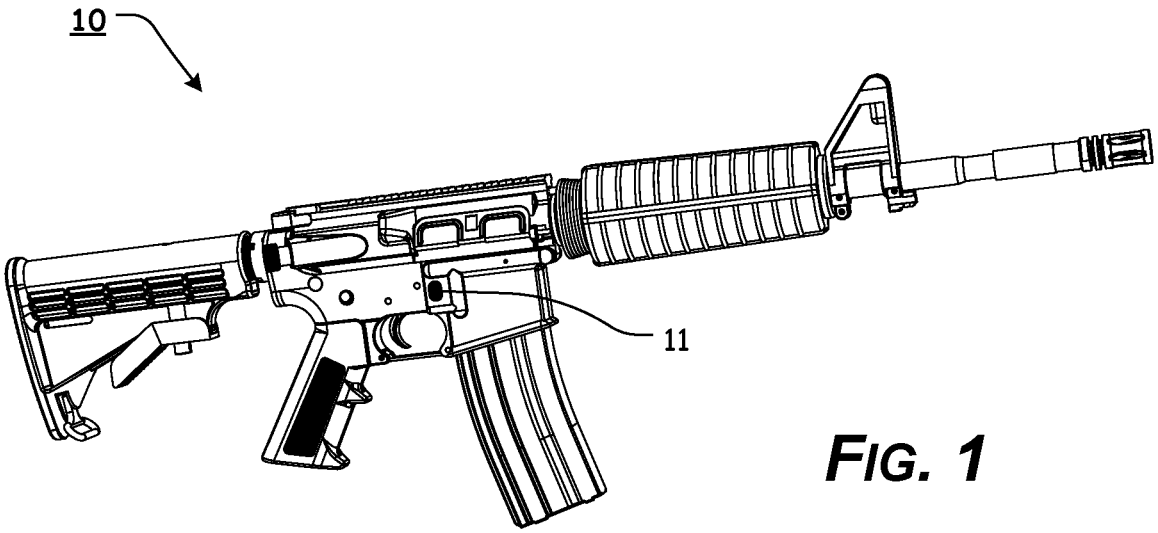
FIG. 1 PRIOR ART
FIG. 1 illustrates a perspective view of certain components of an AR-15 style firearm.
Figure 2:
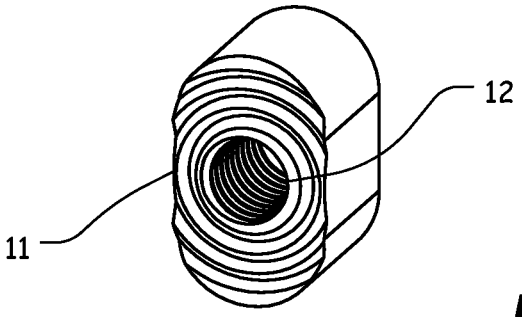
FIG. 2 PRIOR ART
FIG. 2 illustrates a more detailed view of a known magazine release button for an AR-15 style firearm.
Figure 3:
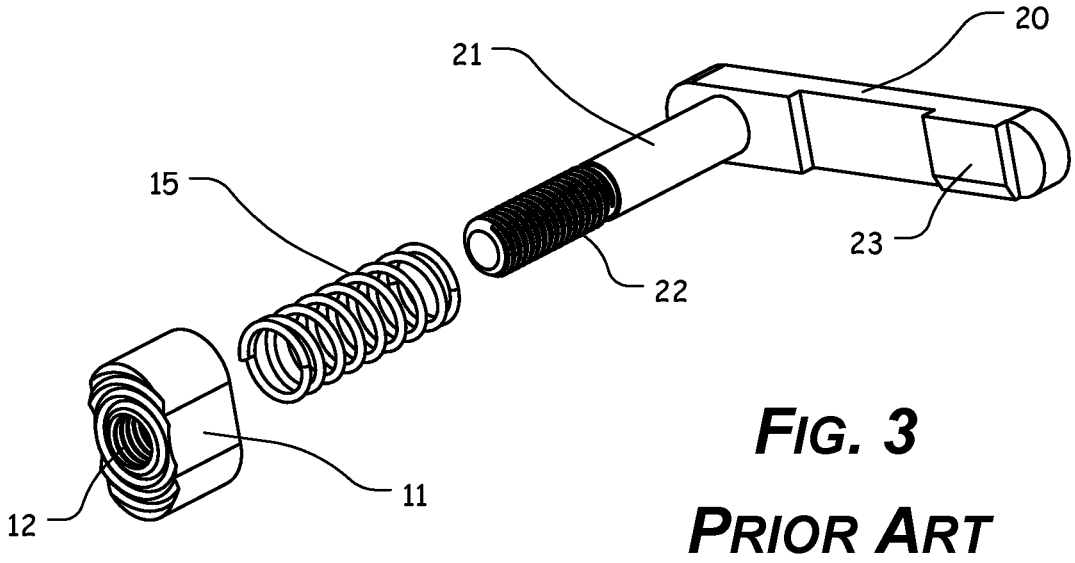
FIG. 3 PRIOR ART
FIG. 3 illustrates a more detailed, exploded view of the components of the known magazine release and magazine release button.
Figure 4:
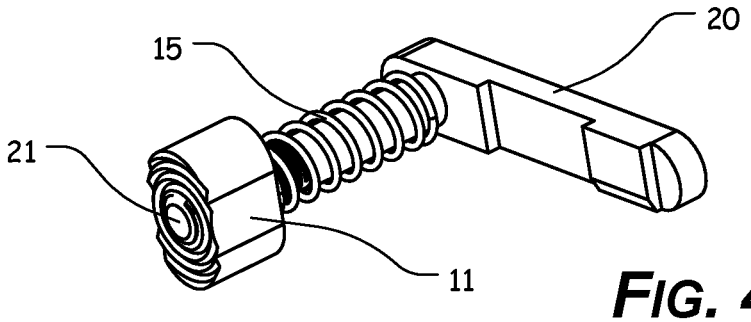
FIG. 4 PRIOR ART
FIG. 4 illustrates a more detailed, assembled view of the components of the known magazine release and magazine release button.
Figure 5:
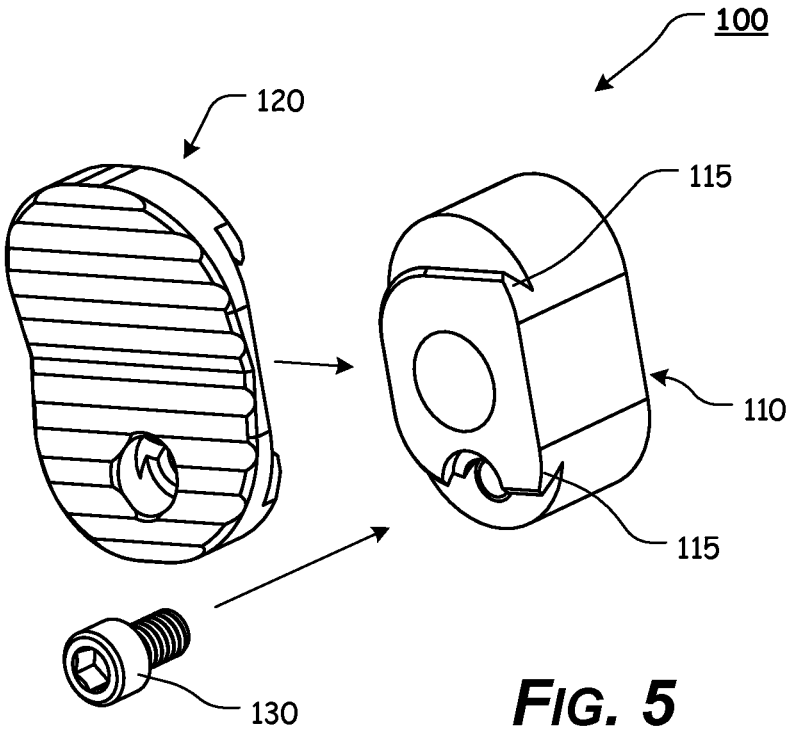
FIG. 5 illustrates an exploded view showing the components of an exemplary embodiment of a magazine release button assembly, according to the present disclosure.
Figure 6:
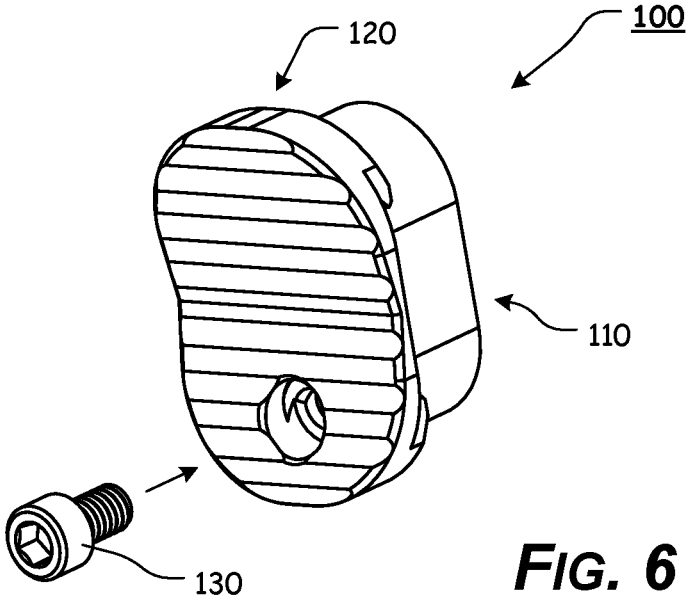
FIG. 6 illustrates a partially exploded view showing the components of an exemplary embodiment of a magazine release button assembly, according to the present disclosure.
Figure 7:
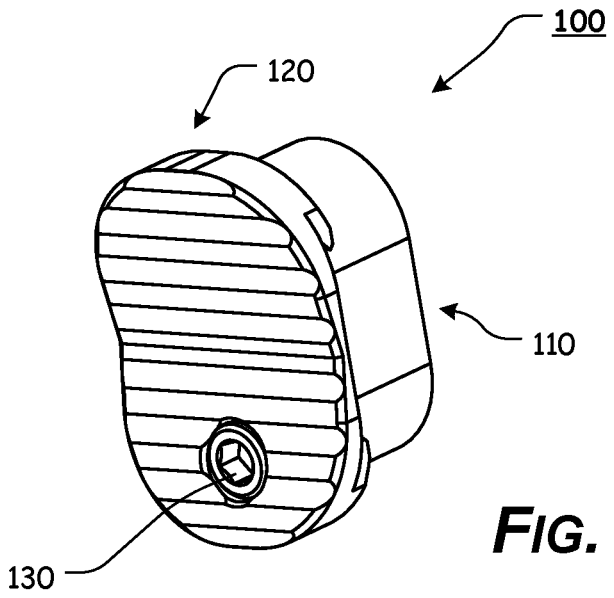
FIG. 7 illustrates a perspective view of an exemplary embodiment of a magazine release button assembly, according to the present disclosure.
Figure 8:
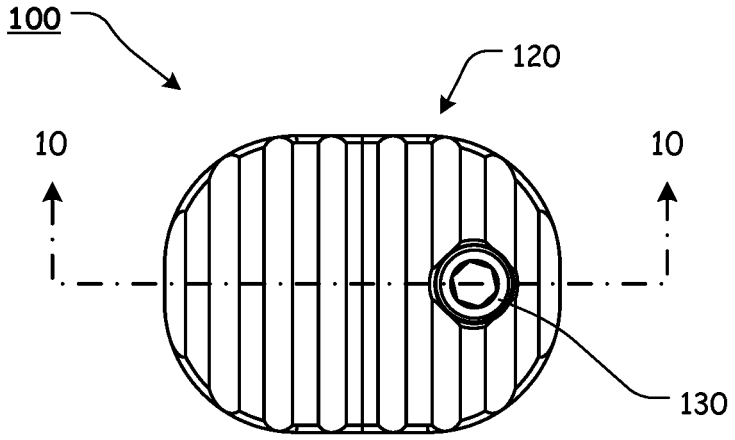
FIG. 8 illustrates a top view of an exemplary embodiment of a magazine release button assembly, according to the present disclosure.
Figure 9:
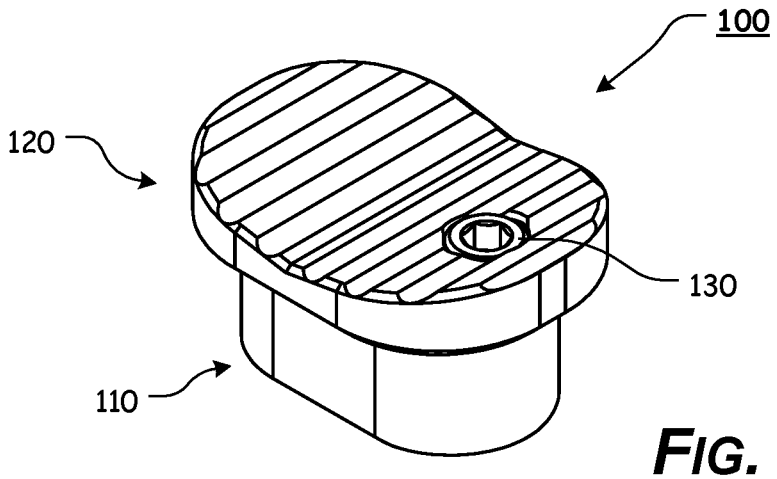
FIG. 9 illustrates a first, upper, perspective view of an exemplary embodiment of a magazine release button assembly, according to the present disclosure.
Figure 10:
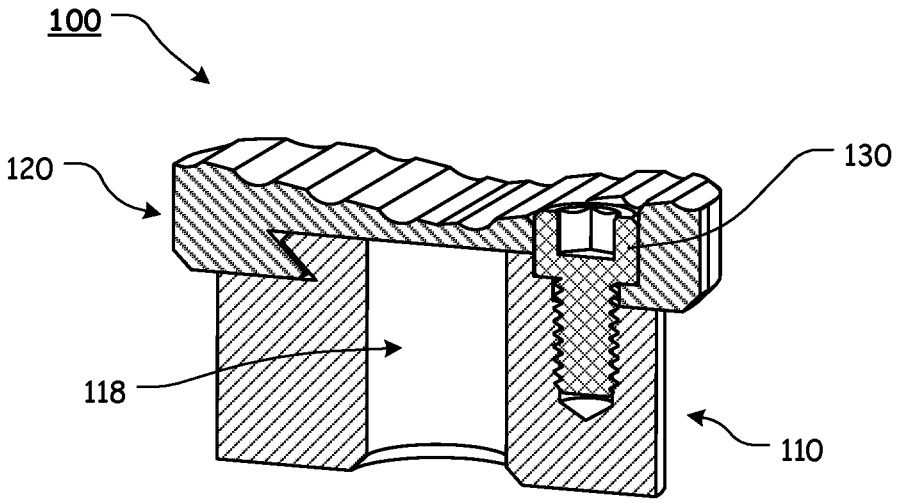
FIG. 10 illustrates a cross-sectional view, taken along line 10-10 of FIG. 8, of an exemplary embodiment of a magazine release button assembly, according to the present disclosure.
Figure 11:
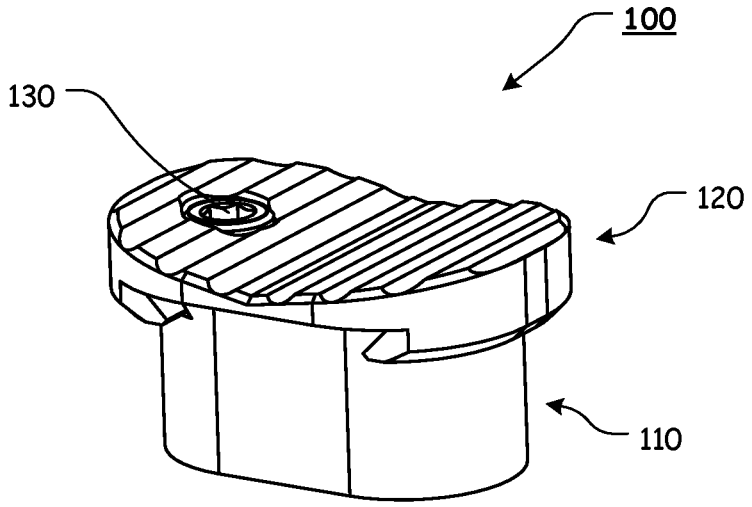
FIG. 11 illustrates a second, upper, perspective view of an exemplary embodiment of a magazine release button assembly, according to the present disclosure.
Figure 12:
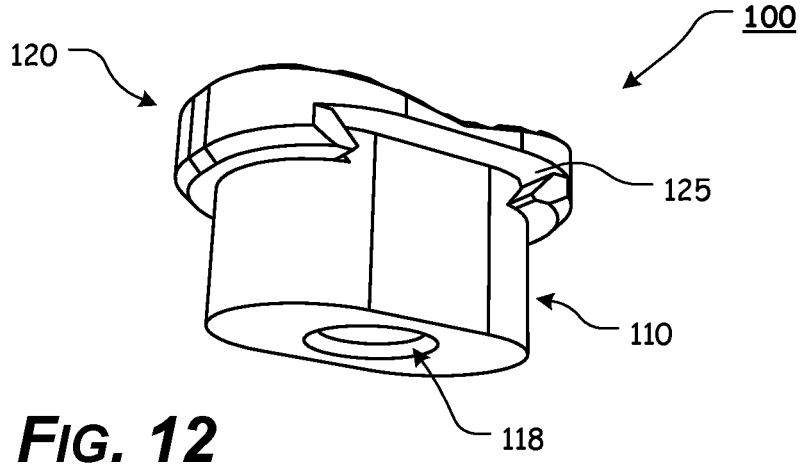
FIG. 12 illustrates a first, lower, perspective view of an exemplary embodiment of a magazine release button assembly, according to the present disclosure.
Figure 13:
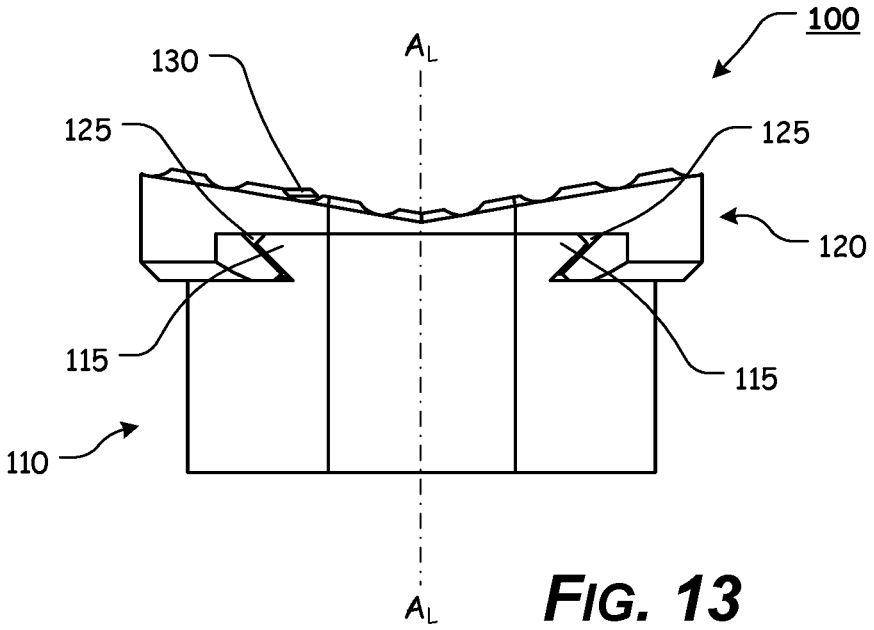
FIG. 13 illustrates a front view of an exemplary embodiment of a magazine release button assembly, according to the present disclosure.
Figure 14:
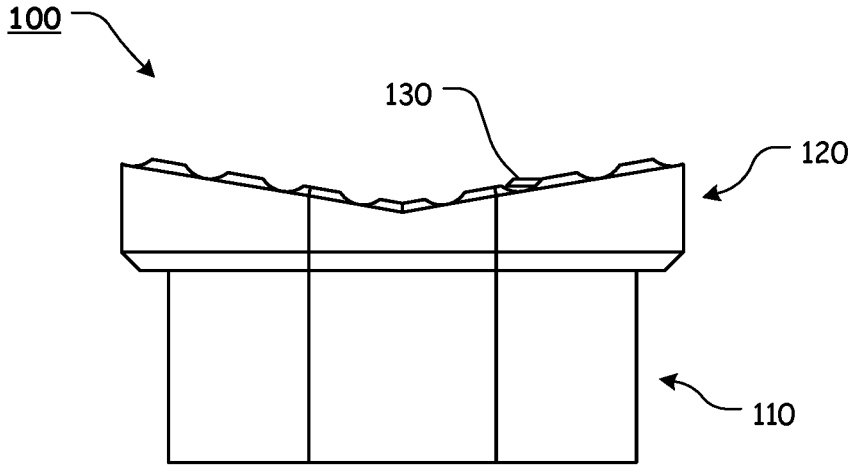
FIG. 14 illustrates a rear view of an exemplary embodiment of a magazine release button assembly, according to the present disclosure.
Figure 15:
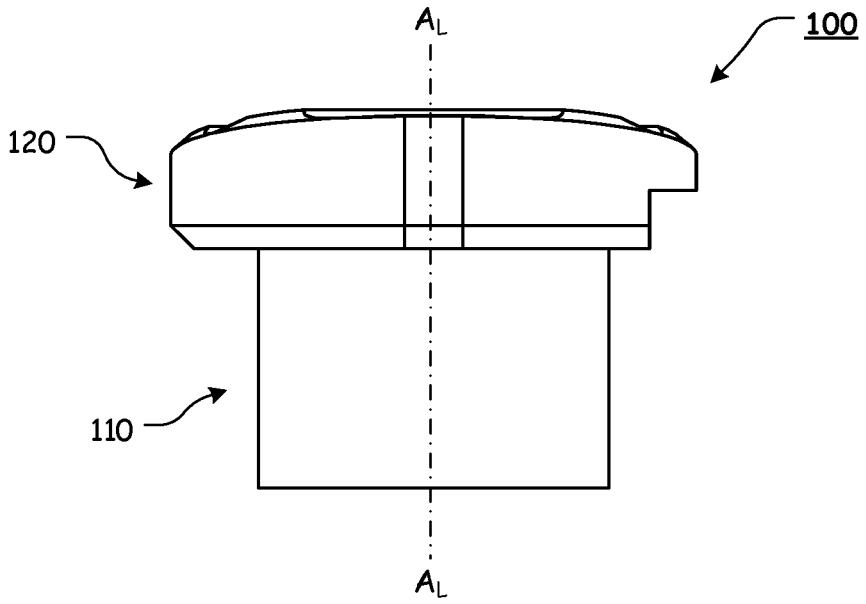
FIG. 15 illustrates a left side view of an exemplary embodiment of a magazine release button assembly, according to the present disclosure.
Figure 16:
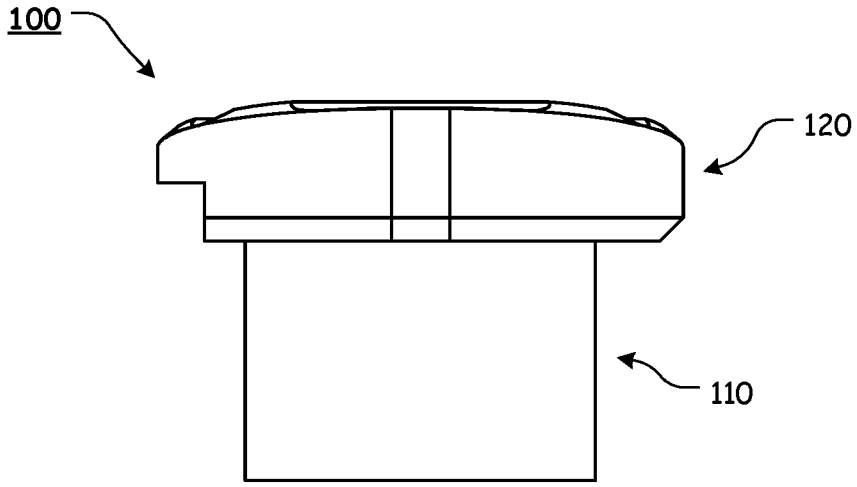
FIG. 16 illustrates a right side view of an exemplary embodiment of a magazine release button assembly, according to the present disclosure.
Figure 17:
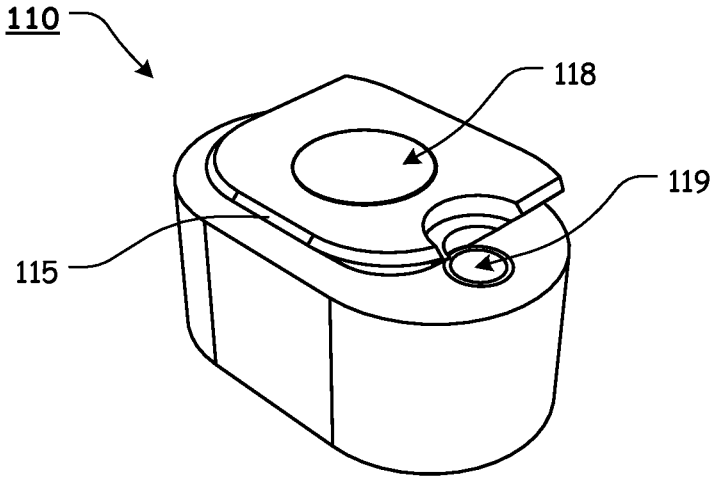
FIG. 17 illustrates a first, upper, perspective view of an exemplary embodiment of a magazine release button assembly, according to the present disclosure.
Figure 18:
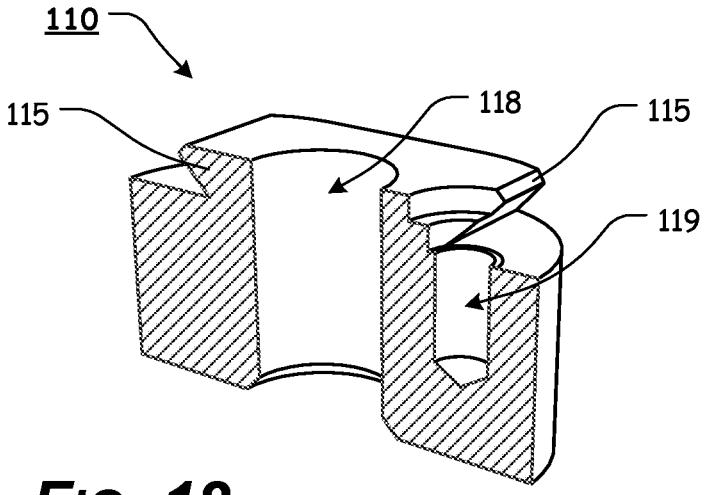
FIG. 18 illustrates a cross-sectional view, taken along line 18-18 of FIG. 21, of an exemplary embodiment of a magazine release button assembly, according to the present disclosure.
Figure 19:
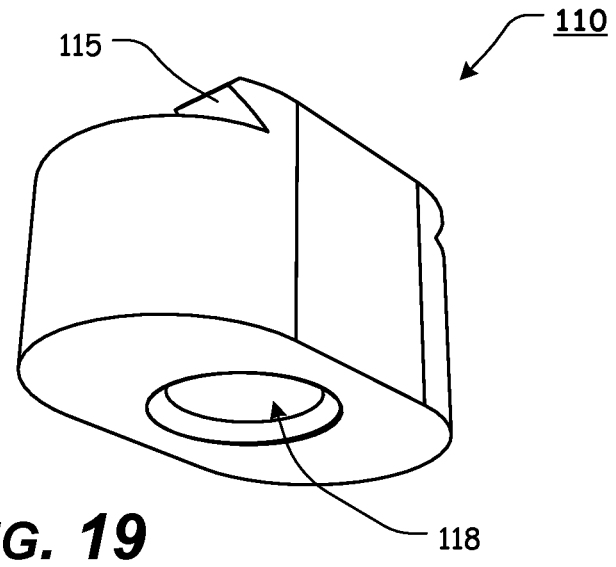
FIG. 19 illustrates a first, lower, perspective view of an exemplary embodiment of a magazine release button assembly, according to the present disclosure.
Figure 20:
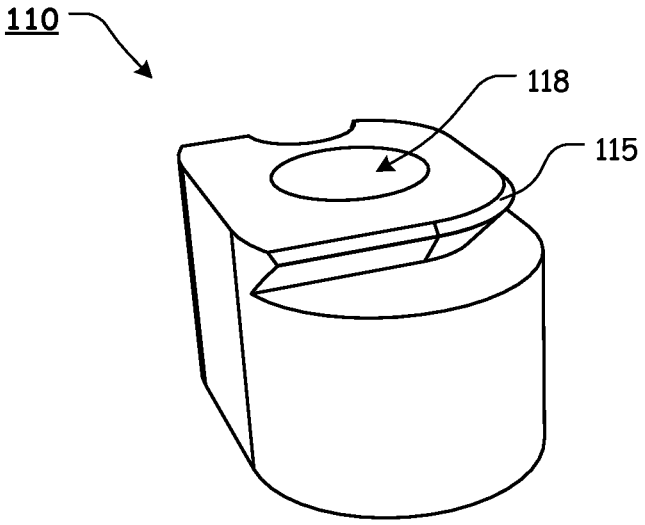
FIG. 20 illustrates a second, upper, perspective view of an exemplary embodiment of a magazine release button assembly, according to the present disclosure.
Figure 21:
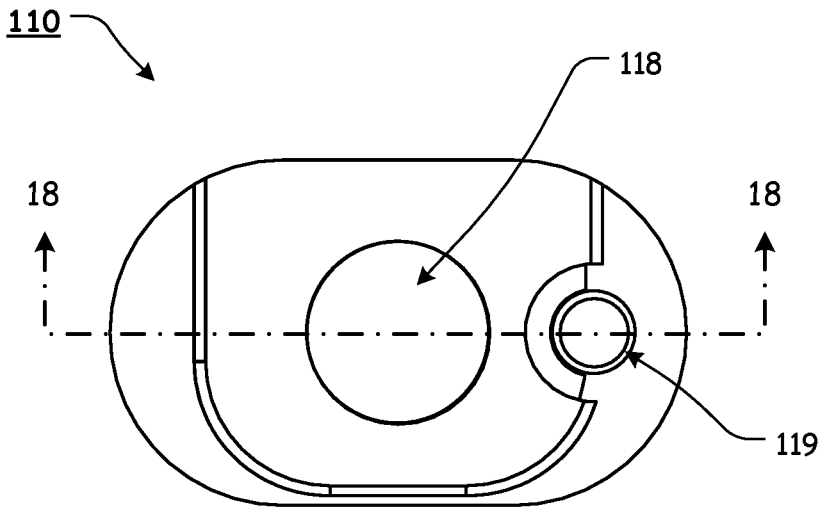
FIG. 21 illustrates a top view of an exemplary embodiment of a magazine release button assembly, according to the present disclosure.
Figure 22:
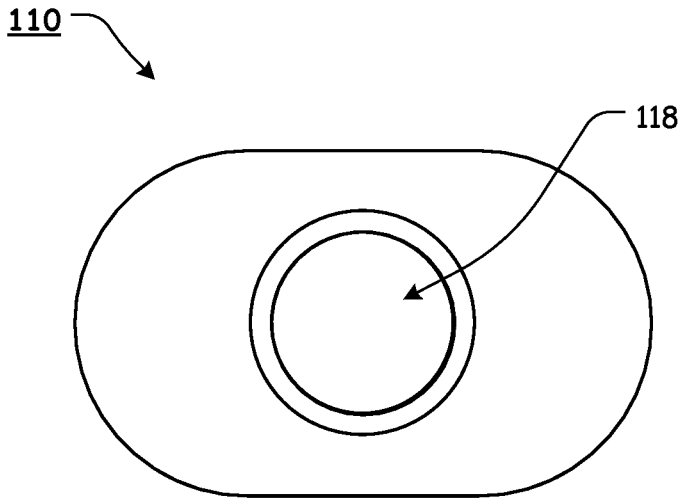
FIG. 22 illustrates a bottom view of an exemplary embodiment of a magazine release button assembly, according to the present disclosure.
Figure 23:
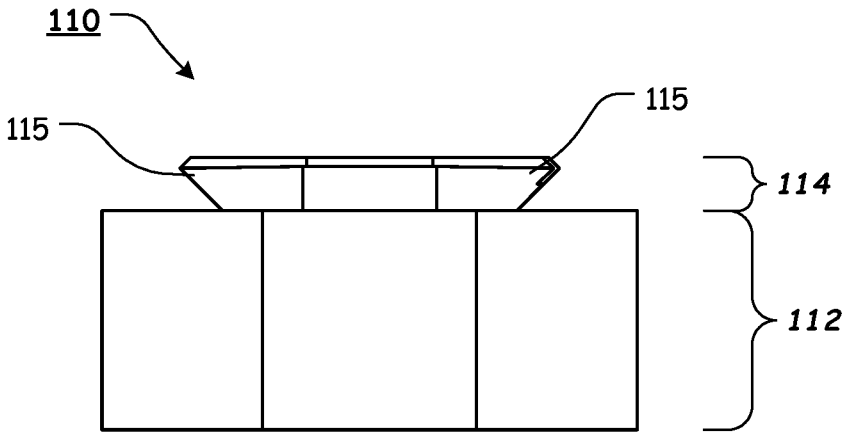
FIG. 23 illustrates a front side view of an exemplary embodiment of a magazine release button assembly, according to the present disclosure.
Figure 24:
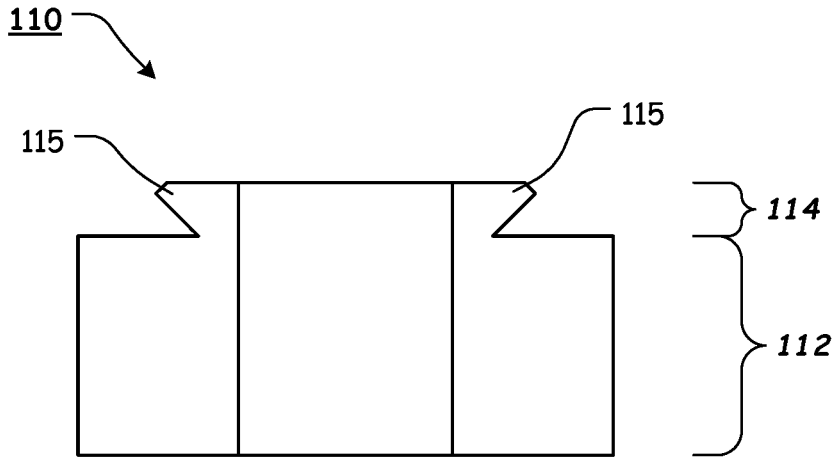
FIG. 24 illustrates a rear side view of an exemplary embodiment of a magazine release button assembly, according to the present disclosure.
Figure 25:
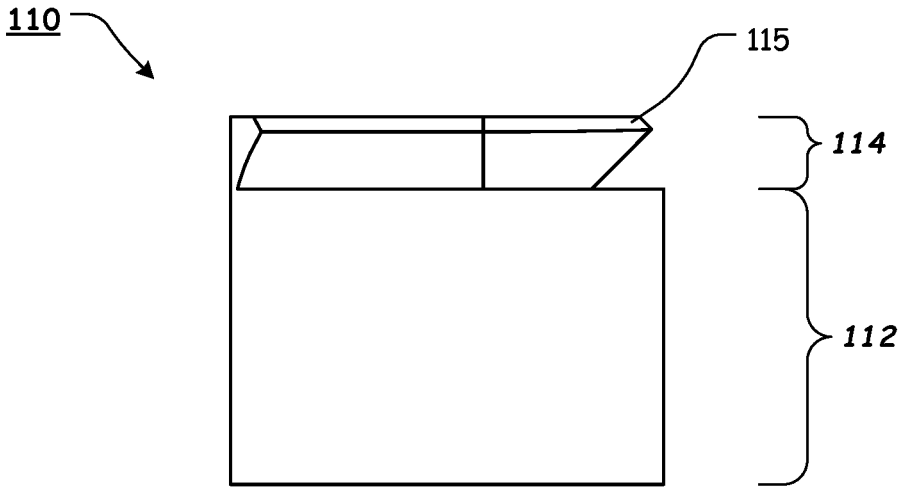
FIG. 25 illustrates a right side view of an exemplary embodiment of a magazine release button assembly, according to the present disclosure.
Figure 26:
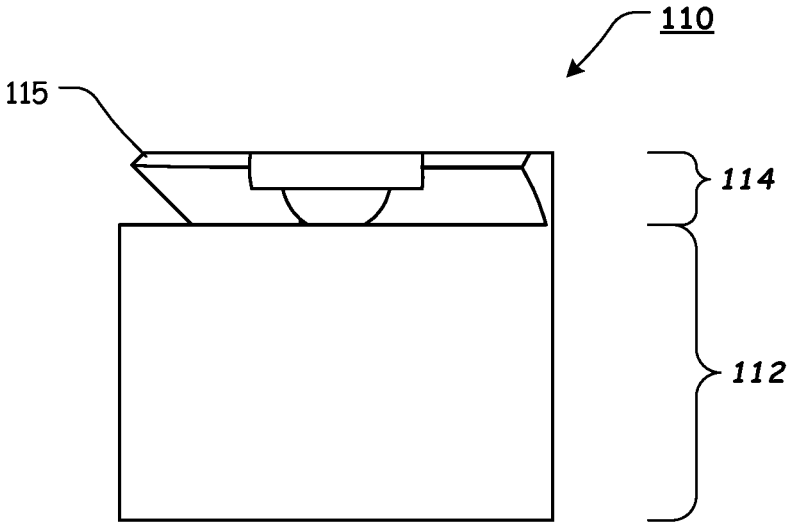
FIG. 26 illustrates a left side view of an exemplary embodiment of a magazine release button assembly, according to the present disclosure.
Figure 27:
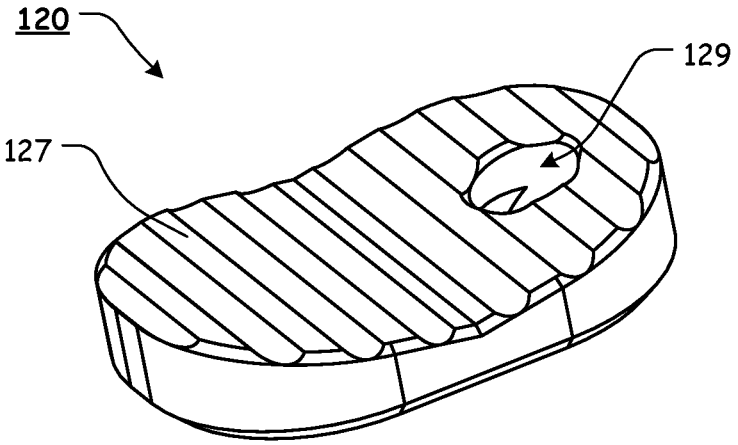
FIG. 27 illustrates a first, upper, perspective view of an exemplary embodiment of a magazine release button assembly finger pad, according to the present disclosure.
Figure 28:
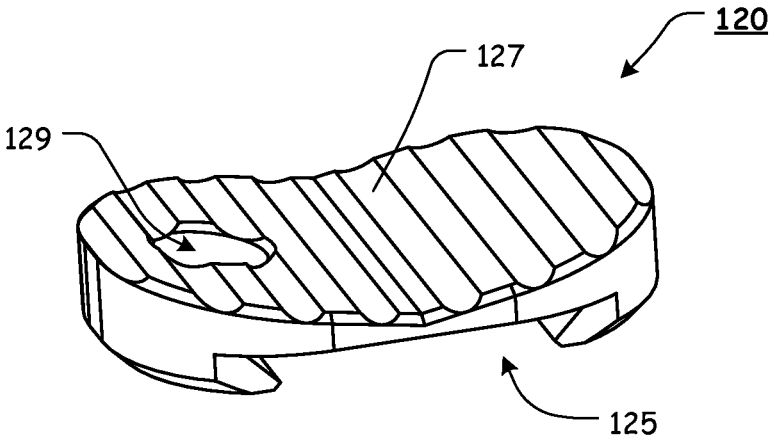
FIG. 28 illustrates a second, upper, perspective view of an exemplary embodiment of a magazine release button assembly finger pad, according to the present disclosure.
Figure 29:
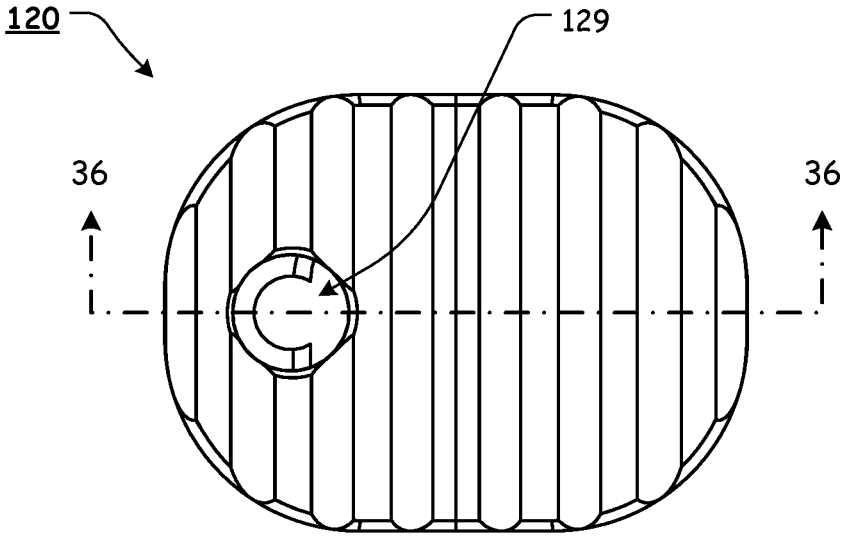
FIG. 29 illustrates a top view of an exemplary embodiment of a magazine release button assembly finger pad, according to the present disclosure.
Figure 30:
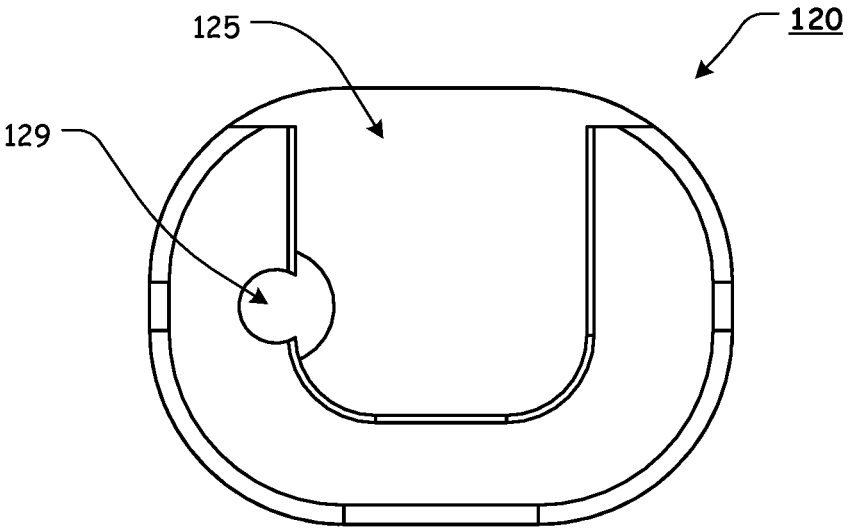
FIG. 30 illustrates a bottom view of an exemplary embodiment of a magazine release button assembly finger pad, according to the present disclosure.
Figure 31:
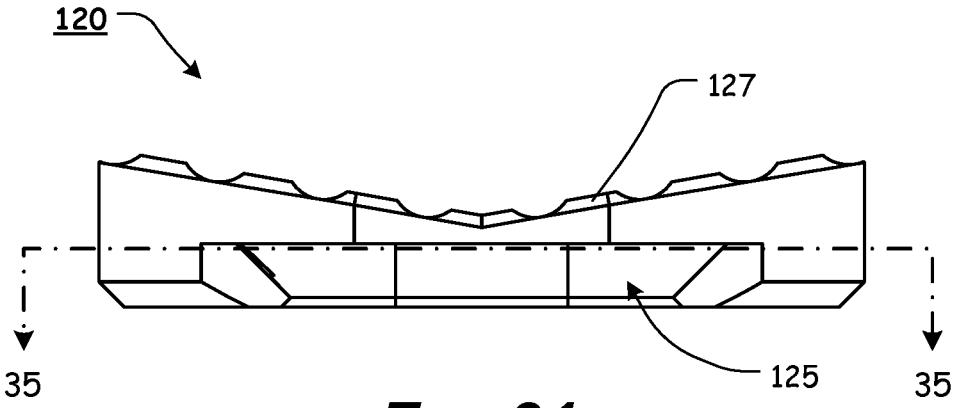
FIG. 31 illustrates a front side view of an exemplary embodiment of a magazine release button assembly finger pad, according to the present disclosure.
Figure 32:
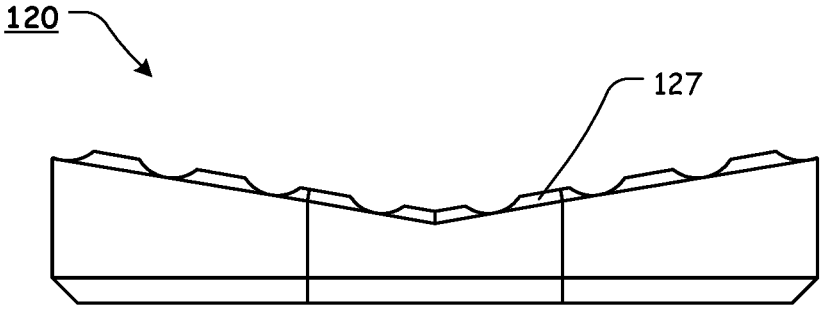
FIG. 32 illustrates a rear side view of an exemplary embodiment of a magazine release button assembly finger pad, according to the present disclosure.
Figure 33:
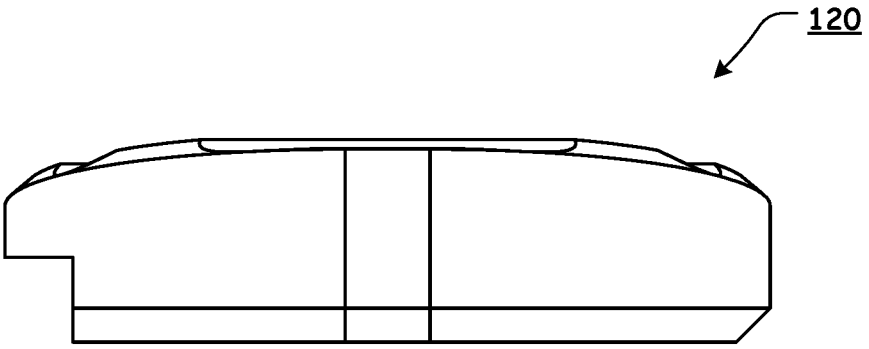
FIG. 33 illustrates a right side view of an exemplary embodiment of a magazine release button assembly finger pad, according to the present disclosure.
Figure 34:
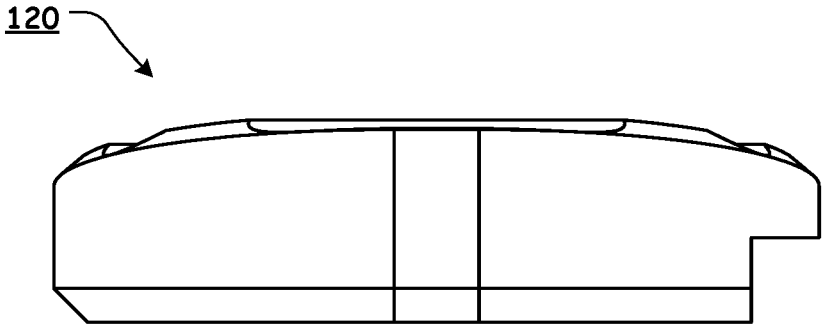
FIG. 34 illustrates a left side view of an exemplary embodiment of a magazine release button assembly finger pad, according to the present disclosure.
Figure 35:
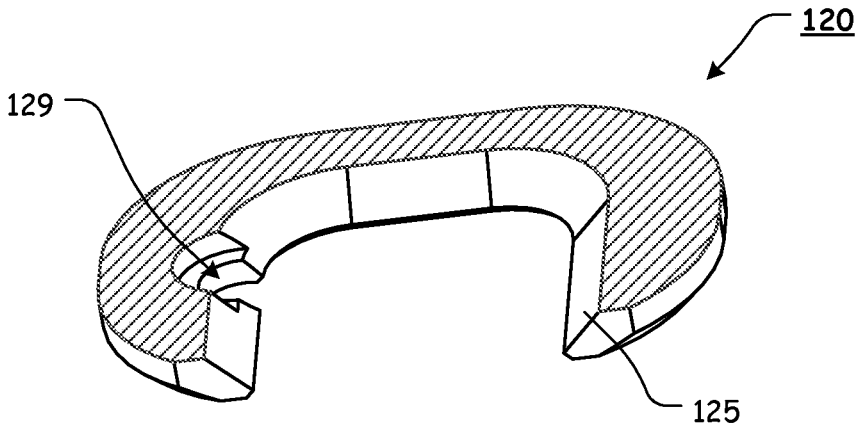
FIG. 35 illustrates a cross-sectional view, taken along line 35-35 of FIG. 31, of an exemplary embodiment of a magazine release button assembly finger pad, according to the present disclosure.
Figure 36:
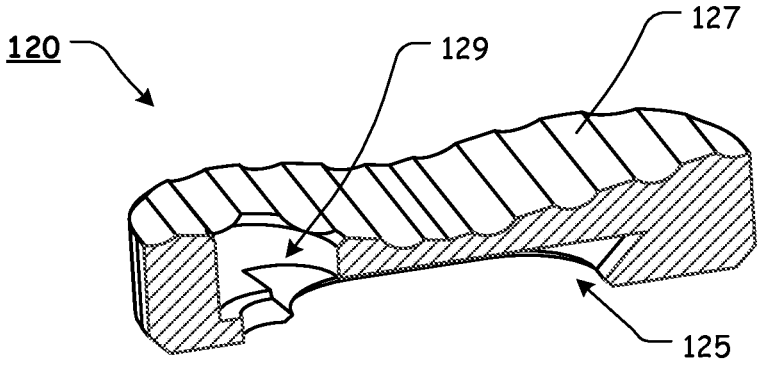
FIG. 36 illustrates a cross-sectional view, taken along line 36-36 of FIG. 29, of an exemplary embodiment of a magazine release button assembly finger pad, according to the present disclosure.

For simplicity and clarification, the design factors and operating principles of the magazine release button assembly according to the present disclosure are explained with reference to various exemplary embodiments of a magazine release button assembly according to the present disclosure. The basic explanation of the design factors and operating principles of the magazine release button assembly is applicable for the understanding, design, and operation of the magazine release button assembly of the present disclosure. It should be appreciated that the magazine release button assembly can be adapted to many applications where a magazine release button assembly or strap can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "magazine release button assembly", "magazine release button", and "firearm" are used for basic explanation and understanding of the operation of the systems, methods, and apparatuses of the present disclosure. Therefore, the terms "magazine release button assembly", "magazine release button", and "firearm" are not to be construed as limiting the systems, methods, and apparatuses of the present disclosure.

For simplicity and clarification, the magazine release button assembly of the present disclosure will be described as being used in conjunction with a firearm, such as a rifle or carbine. However, it should be appreciated that these are merely exemplary embodiments of the magazine release button assembly and are not to be construed as limiting the present disclosure. Thus, the magazine release button assembly of the present disclosure may be utilized in conjunction with any firearm, object, or device.

Turning now to the drawing Figs., FIGS. 5-16 illustrate certain elements and/or aspects of an exemplary embodiment of the magazine release button assembly, according to the present disclosure. FIGS. 17-26 illustrate certain elements and/or aspects of an exemplary embodiment of the enhanced magazine release button member, while FIGS. 27-36 illustrate certain elements and/or aspects of an exemplary embodiment of the magazine release button assembly finger pad.

In illustrative, non-limiting embodiment(s) of the present disclosure, as illustrated in FIGS. 5-36, the magazine release button assembly 100 comprises a button member 110 (having a main body portion 112 and a projection portion 114) and a finger pad member 120.

It should be appreciated that while the finger pad member 120 is illustrated as having a profile (when viewed from the top) of a rounded rectangle, the finger pad member 120 may have a rectangular, square, circular, elliptical, triangular, or any other desired geometric shape. Thus, the overall size, shape, and/or appearance of the finger pad member 120 is a design choice based upon the desired ornamental appearance and/or functionality of the finger pad member 120.

Figure 41:
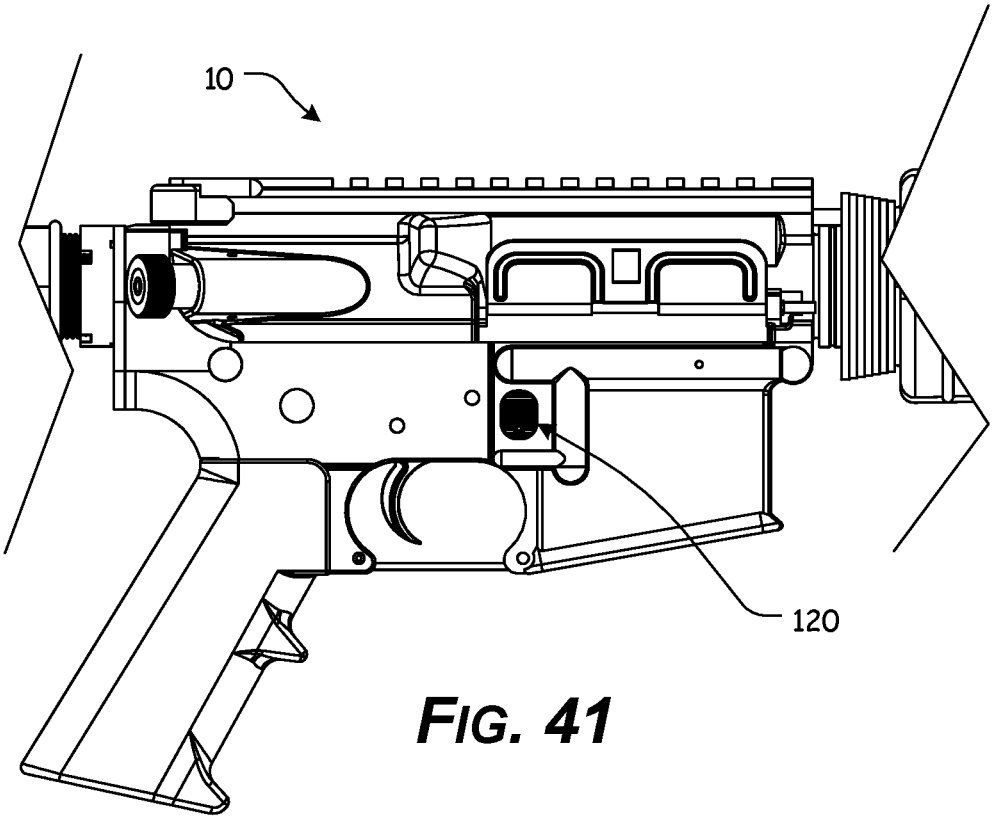
FIG. 41 illustrates an exemplary embodiment of a magazine release button assembly installed in an exemplary rifle, according to the present disclosure.

It should also be appreciated that at least a portion, if not all, of the finger pad member 120 has a larger lateral profile (height and width) than the lateral profile (height and width) of the button member 110. Thus, the size and shape of the finger pad member 120 allows a portion, if not all, of the finger pad member 120 to overhang button member 110 and, when installed, as illustrated in FIG. 41, the aperture formed in the firearm 10 for receiving the button member 110.

In the form of the present disclosure chosen for purposes of illustration, FIGS. 5-16 show various exploded, partially exploded, and assembled views of the magazine release button assembly 100, removed from a firearm. The magazine release button assembly 100 comprises at least some of a button member 110 and a finger pad member 120 secured to the projection portion 114 of the button member 110.

The button member 110 includes a primary threaded aperture 118 formed through the button member 110, parallel to a longitudinal axis $A_L$ of the button member 110. The primary threaded aperture 118 is formed so as to interact with a threaded portion of a magazine release, so that the button member 110 can be utilized in conjunction with a standard magazine release and installed in a fashion similar to that of a standard magazine release button.

The button member 110 also includes a secondary aperture 119 formed at least partially through the button member 110. The secondary aperture 119 is also formed parallel to a longitudinal axis $A_L$ of the button member 110, at a distance spaced apart from the primary threaded aperture 118. The secondary aperture 119 is formed so as to receive at least a portion of the fastener 130, when the fastener 130 is also used to secure the finger pad member 120 to the button member 110.

In various exemplary embodiments, as illustrated herein, the fastener 130 comprises a screw and the secondary aperture 119 comprises a threaded or at least partially threaded aperture. It should be appreciated that in other exemplary embodiments, the fastener 130 may comprise, for example, a roll pin and the secondary aperture 119 may comprise a non-threaded aperture sized so as to receive and be frictionally engaged with the roll pin.

As further illustrated, the finger pad member 120 includes a recess 125 mateable with the projection 115 of the button member 110. Thus, when assembled, the finger pad member 120 is slidably secured to the end of the button member 110 via interaction of the projection 115 and the recess 125.

In various exemplary embodiments, as illustrated, the finger pad member 120 is optionally further secured to the projection portion 114 by suitable means, such as, for example, a fastener 130. The recessed design of the present disclosure provides a very solid attachment in which the fastener 130 simply prevents the finger pad member 120 from sliding along the recesses 125.

The button member 110 has a projection 115 formed in the projection portion 114 of the button member 110 and the finger pad member 120 is formed with recess 125, which mates with the projection 115. The projection 115 is a dovetail projection 115 and the recess 125 in the finger pad member 120 is a mating, dovetailed recess 125. More specifically, the illustrated projection 115 is a 3-sided dovetail projection 115 and the recess 125 in the finger pad member 120 is a 3-sided dovetailed recess 125. It should be appreciated that, in various exemplary embodiments, the projection 115 merely comprises a 2-sided dovetail projection, wherein the dovetail projections are on opposing sides relative to one another. In these embodiments, the recess 125 comprises a mating, 2-sided dovetail recess.

The finger pad member 120 further comprises a finger pad member aperture 129 formed therethrough. When the finger pad member 120 is secured to the button member 110, the finger pad member aperture 129 aligns with the secondary aperture 119, such that the fastener 130 can be secured through the finger pad member aperture 129 and the secondary aperture 119.

Figure 43:
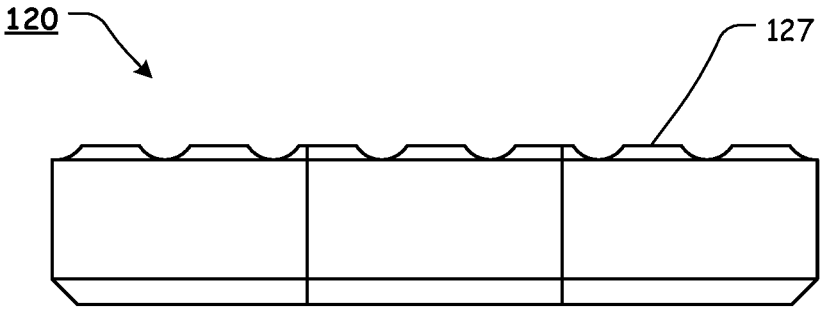
FIG. 43 illustrates a rear side view of an alternate embodiment of a magazine release button assembly finger pad, according to the present disclosure.
Figure 44:
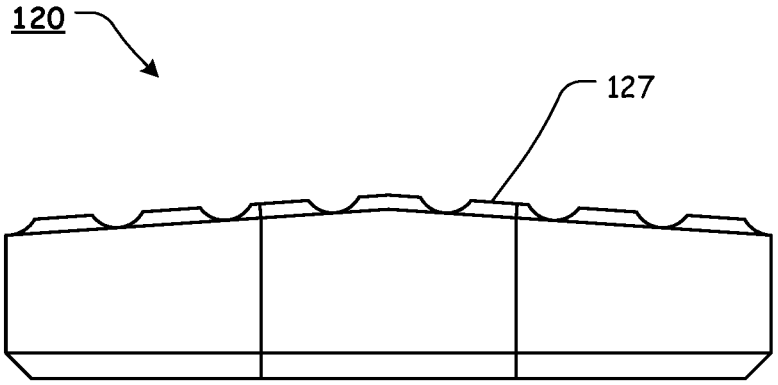
FIG. 44 illustrates a rear side view of yet another alternate embodiment of a magazine release button assembly finger pad, according to the present disclosure.

In certain exemplary embodiments, the finger pad member 120 has a generally "U", "V", or surface 127 formed with a plurality of parallel grooves. These grooves, if included, serve to prevent the user's finger from slipping off the finger pad member 120. In various exemplary, nonlimiting embodiments, the finger pad member 120 comprises a textured surface 127. In certain exemplary embodiments, the surface 127 may be textured or non-textured and may be substantially concave. Alternatively, as illustrated in FIG. 43, the surface 127 may be textured or non-textured and may be substantially flat. In still other alternative embodiments, as illustrated in FIG. 44 the surface 127 may be textured or non-textured and may be substantially convex. Thus, it should be appreciated that the surface 127 may be textured or non-textured and may be substantially flat, concave, or convex, based upon the desired appearance and/or functionality of the finger pad member 120.

In various exemplary embodiments, the surface 127 is concave and the concavity of the surface 127 is parallel to the boar axis of the firearm. In this manner, the surface 127 acts to "self-center" the user's finger on the center of the finger pad member 120, thereby limiting lateral movement of the user's finger (up-and-down relative to the side wall of the firearm 10) and centering pressure from the user's finger on the center of the finger pad member 120.

In various exemplary, nonlimiting embodiments, the present disclosure optionally provides a plurality of interchangeable finger pad members 120 of different lengths, widths, thicknesses, configurations, profiles, and/or surface preparations to allow a user to select a finger pad member 120 that is most satisfactory to the shooter. It should be appreciated that, based upon the modularity of the present disclosure, finger pad members 120 may be exchanged or interchanged as desired, without having to remove the button member 110 from the firearm.

For example, a taller finger pad member may even extend above the ridge that typically extends from the receiver of the firearm to protect the magazine release button from inadvertent manipulation. This taller finger pad member 120 may be utilized by users competing in, for example, three gun matches who prefer to be able to "slap" the magazine release button and release the magazine without concern about having a low-profile magazine release button.

In various exemplary embodiments, various components of the magazine release button assembly 100 are substantially rigid and are formed of aluminum. Alternate materials of construction of the various components of the magazine release button assembly 100 may include one or more of the following: steel, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the magazine release button assembly 100 is a design choice based on the desired appearance and functionality of the magazine release button assembly 100.

It should be appreciated that certain elements of the magazine release button assembly 100 may be formed as an integral unit (such as, for example, the button member 110 and the finger pad member 120). Alternatively, suitable materials can be used and sections or elements made independently and attached or coupled together, such as by adhesives, welding, screws, rivets, pins, or other fasteners, to form the various elements of the magazine release button assembly 100.

It should also be understood that the overall size and shape of the magazine release button assembly 100 and the various portions thereof, the button member 110, and the finger pad members 120, is a design choice based upon the desired functionality and/or appearance of the magazine release button assembly 100.

It should also be appreciated that a more detailed explanation of the instructions regarding how to install the button member 110 of the magazine release button assembly 100 are not provided herein because such background information will be known to one of ordinary skill in the art. Therefore, it is believed that the level of description provided herein is sufficient to enable one of ordinary skill in the art to understand and practice the present disclosure, as described.

In various exemplary embodiments, the enhanced magazine release button 100 comprises a button member 110, wherein the button member 110 includes a primary threaded aperture 118 formed through the button member 110 and a secondary aperture 119 formed at least partially through the button member 110, wherein the secondary aperture 119 is formed at a distance spaced apart from the primary threaded aperture 118, and wherein the button member 110 includes a projection 115 formed on an end of the button member 110; and a finger pad member 120, wherein the finger pad member 120 includes a recess 125 mateable with the projection 115 of the button member 110, wherein the finger pad member 120 further comprises a finger pad member aperture 129 formed therethrough, wherein when the finger pad member 120 is secured to the end of the button member 110, via interaction of the projection 115 and the recess 125, the finger pad member aperture 129 aligns with the secondary aperture 119, such that the finger pad member 120 may be further secured to the end of the button member 110 via a fastener 130 secured through the finger pad member aperture 129 and the secondary aperture 119.

In still other exemplary embodiments, the enhanced magazine release button 100 comprises a button member 110, wherein the button member 110 includes a primary threaded aperture 118 formed through the button member 110 and a secondary aperture 119 formed at least partially through the button member 110, wherein the secondary aperture 119 is formed at a distance spaced apart from the primary threaded aperture 118, and wherein the button member 110 includes a dovetail projection 115 formed on an end of the button member 110; and a finger pad member 120, wherein the finger pad member 120 includes a dovetail recess 125 mateable with the projection 115 of the button member 110, wherein the finger pad member 120 further comprises a finger pad member aperture 129 formed therethrough, wherein when the finger pad member 120 is secured to the end of the button member 110, via interaction of the dovetail projection 115 and the dovetail recess 125, the finger pad member aperture 129 aligns with the secondary aperture 119, such that the finger pad member 120 may be further secured to the end of the button member 110 via a fastener 130 secured through the finger pad member aperture 129 and the secondary aperture 119.

Figure 37:
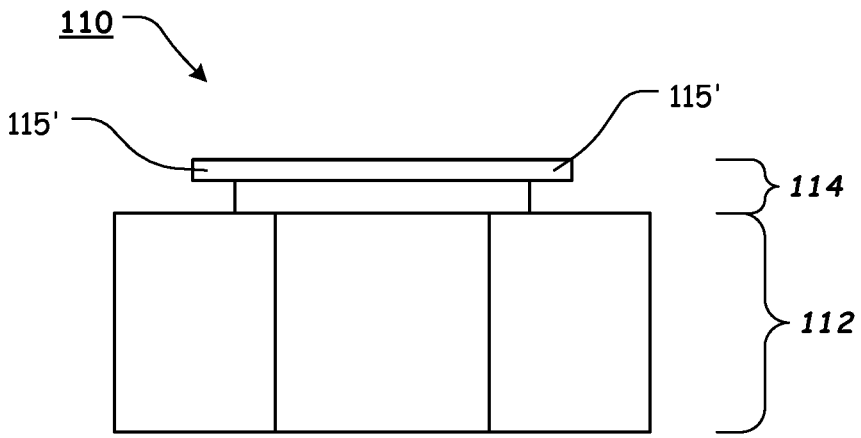
FIG. 37 illustrates a front side view of an exemplary embodiment of a magazine release button assembly, according to the present disclosure.
Figure 38:
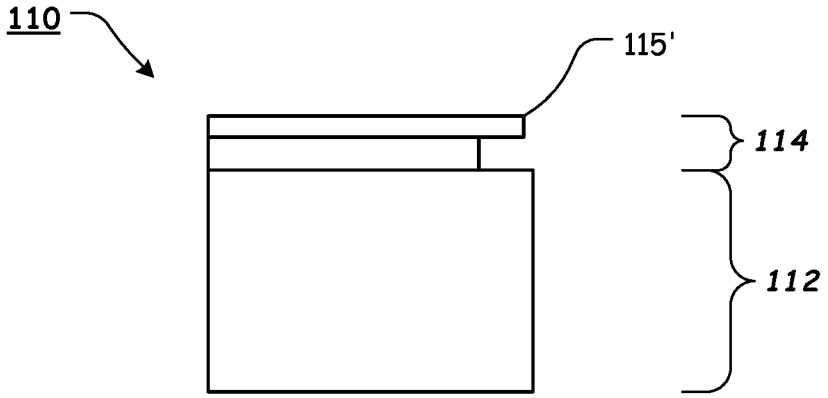
FIG. 38 illustrates a right side view of an exemplary embodiment of a magazine release button assembly, according to the present disclosure.
Figure 39:
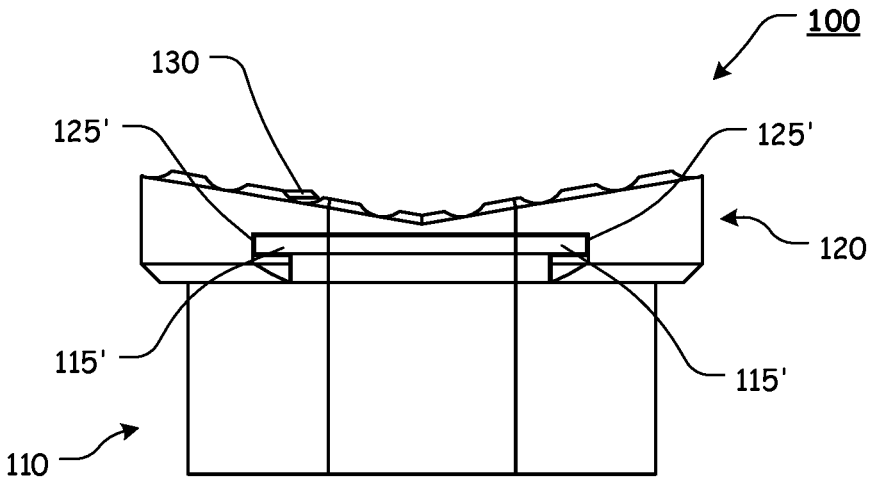
FIG. 39 illustrates a front view of an exemplary embodiment of a magazine release button assembly, according to the present disclosure.

FIGS. 37-39 illustrate an exemplary embodiment of a button member 110 and a finger pad member 120. As illustrated, the button member 110 has a projection 115' formed in the projection portion 114 of the button member 110 and the finger pad member 120 is formed with recess 125', which mates with the projection 115'. The projection 115' is a "T" or square-shaped projection 115' and the recess 125' in the finger pad member 120 is a mating, "T" or square-shaped recess 125'. More specifically, the illustrated projection 115' is a 3-sided "T" or square-shaped projection 115' and the recess 125' in the finger pad member 120 is a 3-sided "T" or square-shaped recess 125'. It should be appreciated that, in various exemplary embodiments, the projection 115' merely comprises a 2-sided "T" or square-shaped projection, wherein the "T" or square-shaped projections are on opposing sides relative to one another. In these embodiments, the recess 125' comprises a mating, 2-sided "T" or square-shaped recess.

Figure 40:
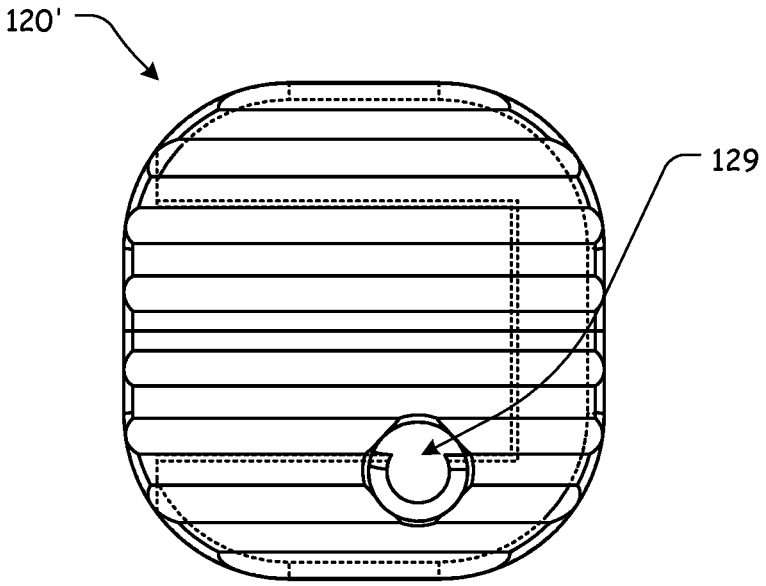
FIG. 40 illustrates a top view of an exemplary embodiment of a magazine release button assembly finger pad, according to the present disclosure.
Figure 42:
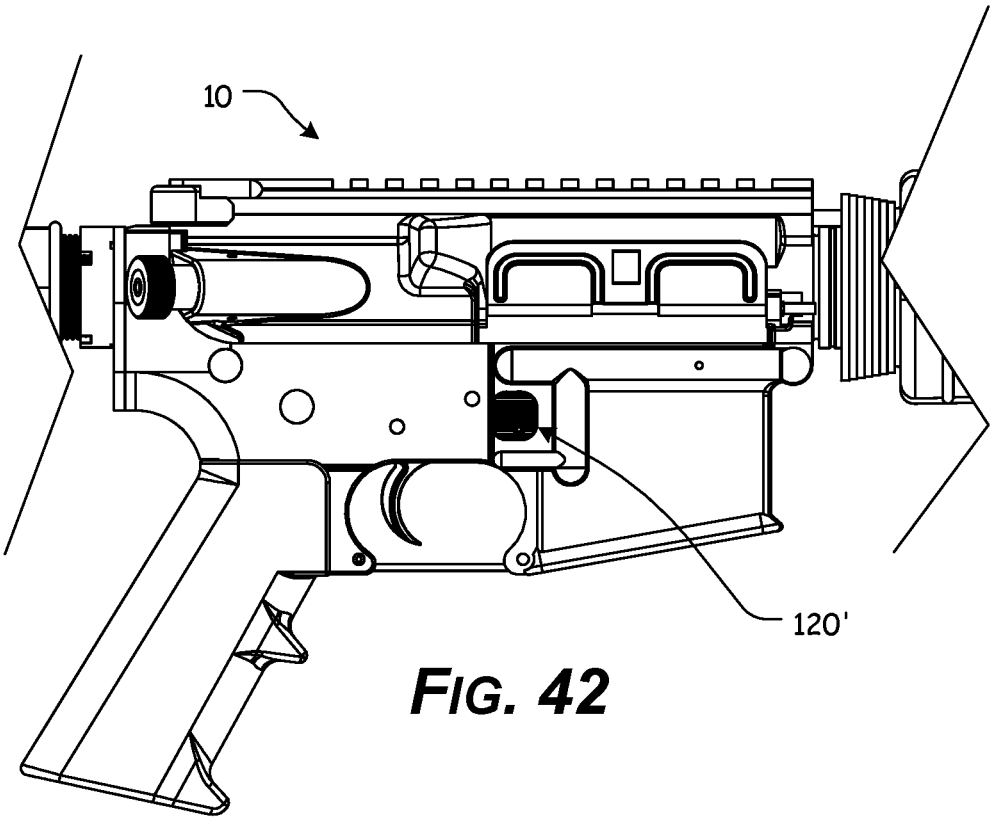
FIG. 42 illustrates an exemplary embodiment of a magazine release button assembly installed in an exemplary rifle, according to the present disclosure.

FIG. 40 illustrates an exemplary embodiment of an interchangeable finger pad member 120'. As illustrated, the finger pad member 120' is elongated, such that when the finger pad member 120' is installed in the firearm 10, as illustrated in FIG. 42, the elongate portion of the finger pad member 120' extends rearward, toward the trigger guard of the firearm 10.

Having such as elongate, rearwardly extending portion of the finger pad member 120' provides an extended finger pad for users who want a more rearward biased finger pad. This is particularly helpful for people with shorter fingers, who have difficulty reaching and manipulating the standard magazine release button without changing their grip position on the firearm.

Because of the interlocking characteristics of the projection 115 or 115' and the recess 125 or 125', the tendency of the finger pad member 120 or 120' to rotate or cam is overcome. Because of the unique characteristics of the present disclosure, the tendency to rotate or cam and the torque created by such motion is overcome with or without use of the fastener 130.

Figure 45:
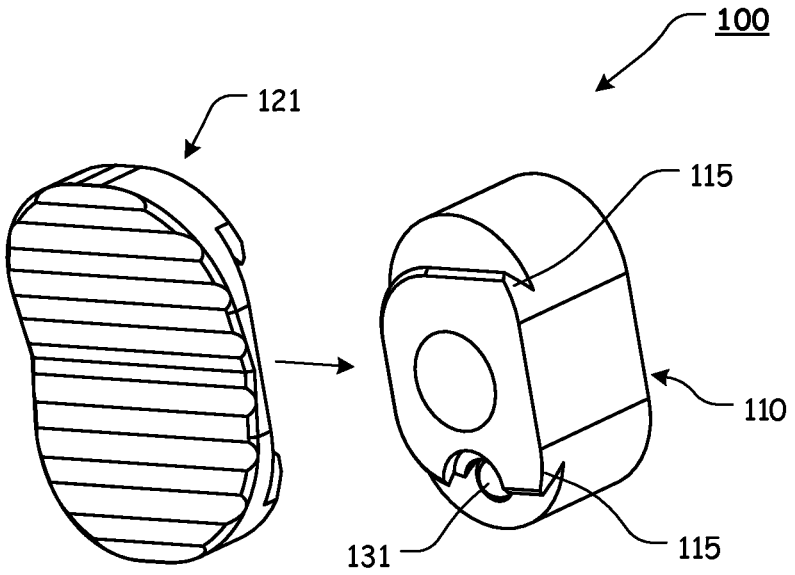
FIG. 45 illustrates an exploded view showing the components of an alternate exemplary embodiment of a magazine release button assembly, according to the present disclosure.
Figure 46:
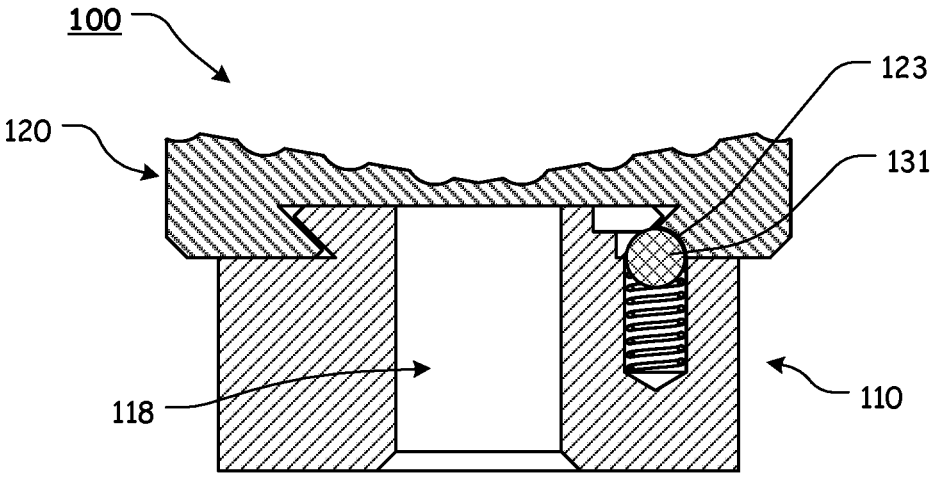
FIG. 46 illustrates cross-sectional view showing the components of the exemplary embodiment of the magazine release button assembly illustrated in FIG. 45, according to the present disclosure.

FIGS. 45 and 46 illustrate an alternative exemplary embodiment of the magazine release button assembly, according to the present disclosure. As illustrated, the secondary aperture 119 includes a captured, spring biased ball 131 and the finger pad member aperture 129 is replaced by a ball detent cavity 123.

In these exemplary embodiments, when the finger pad member 120 is in a determined, attached position, a portion of the spring biased ball 131 interacts with and is captured within a portion of the ball detent cavity 123 to maintain the finger pad member 120 in a desired position relative to the button member 110. It should be understood that in these exemplary embodiments, the fastener 130 comprises the spring biased ball 131, which interacts with the ball detent 123. Thus, the finger pad member aperture 129 is removed and the face of the finger pad member 120 does not include an aperture formed therein.

FIGS. 47-67 illustrate certain elements and/or aspects of an alternate exemplary embodiment of the magazine release button assembly, according to the present disclosure. In certain illustrative, non-limiting embodiments, as illustrated in FIGS. 47-67, the magazine release button assembly 200 comprises a button member 210 (having a main body portion 212 and a projection portion 214) and a finger pad member 220.

It should be appreciated that while the finger pad member 220 is illustrated as having a profile (when viewed from the top) of a generally rounded rectangle, the finger pad member 220 may have a generally rectangular, square, circular, elliptical, triangular, or any other desired geometric shape. Thus, the overall size, shape, and/or appearance of the finger pad member 220 is a design choice based upon the desired ornamental appearance and/or functionality of the finger pad member 220.

It should also be appreciated that at least a portion, if not all, of the finger pad member 220 has a larger lateral profile (height and width) than the lateral profile (height and width) of the button member 210. Thus, the size and shape of the finger pad member 220 allows a portion, if not all, of the finger pad member 220 to overhang button member 210 and, when installed, as illustrated in FIG. 41, the aperture formed in the firearm 20 for receiving the button member 210.

In the form of the present disclosure chosen for purposes of illustration, FIGS. 47-67 show various individual components and assembled views of the magazine release button assembly 200, removed from a firearm. The magazine release button assembly 200 comprises at least some of a button member 210 and a finger pad member 220 secured to the projection portion 214 of the button member 210.

The button member 210 includes a primary threaded aperture 218 formed through the button member 210, parallel to a longitudinal axis $A_L$ of the button member 210. The primary threaded aperture 218 is formed so as to interact with a threaded portion of a magazine release, so that the button member 210 can be utilized in conjunction with a standard magazine release and installed in a fashion similar to that of a standard magazine release button.

The button member 210 also includes a secondary aperture 219 formed at least partially through the button member 210. The secondary aperture 219 is also formed parallel to a longitudinal axis $A_L$ of the button member 210, at a distance spaced apart from the primary threaded aperture 218.

In various exemplary, nonlimiting embodiments, the secondary aperture 219 is formed so as to receive at least a portion of a fastener 230, when the fastener 230 is also used to secure the finger pad member 220 to the button member 210.

Figure 47:
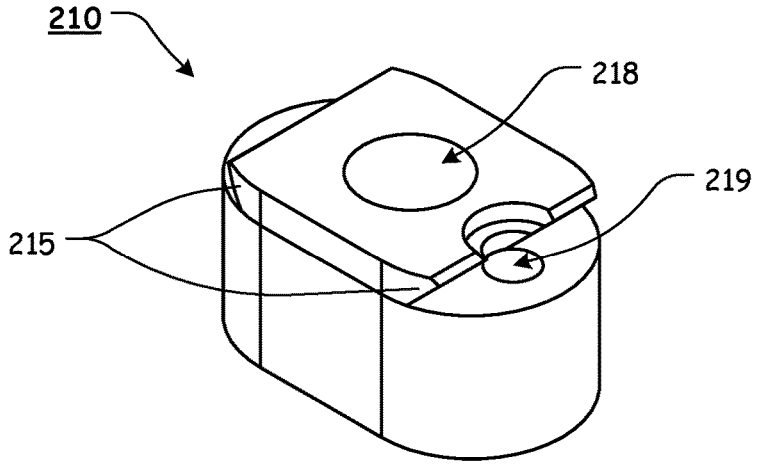
FIG. 47 illustrates an upper, perspective view of an exemplary embodiment of a magazine release button member, according to the present disclosure.
Figure 48:
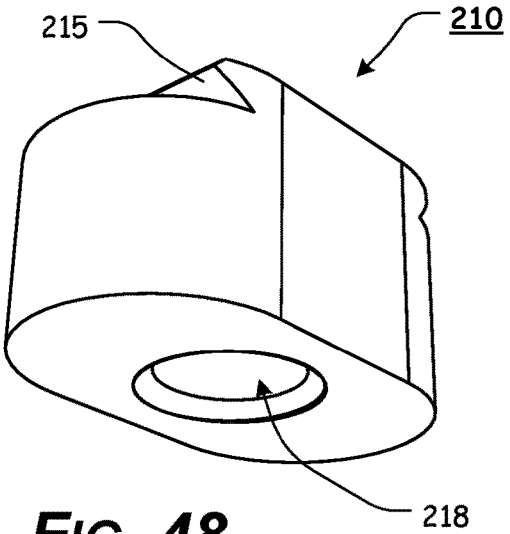
FIG. 48 illustrates a first side, lower, perspective view of an exemplary embodiment of a magazine release button member, according to the present disclosure.
Figure 49:
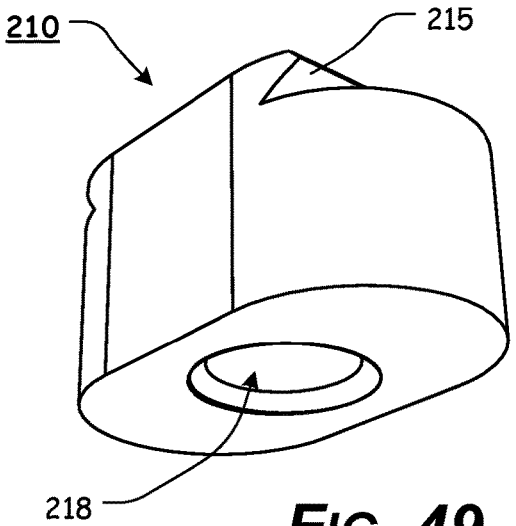
FIG. 49 illustrates a second side, lower, perspective view of an exemplary embodiment of a magazine release button member, according to the present disclosure.
Figure 50:
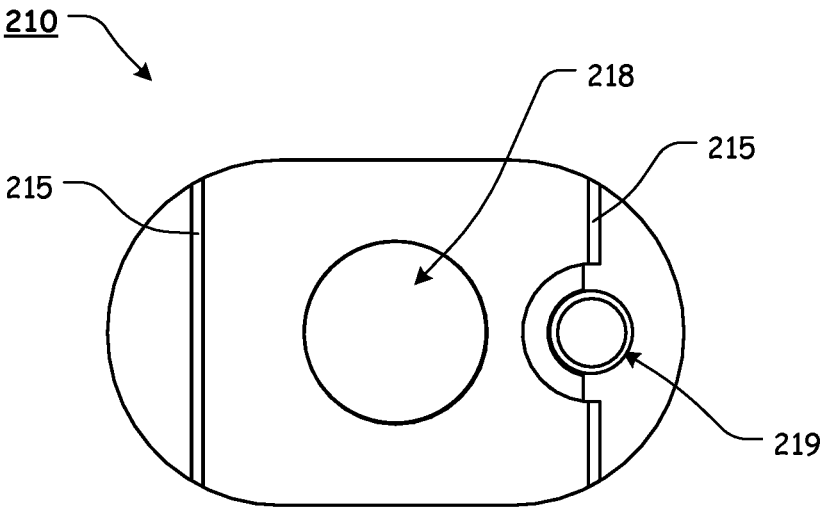
FIG. 50 illustrates a top view of an exemplary embodiment of a magazine release button member, according to the present disclosure.
Figure 51:
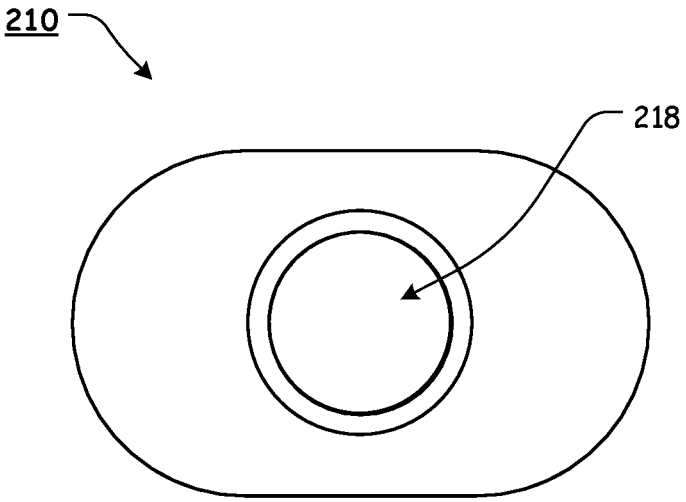
FIG. 51 illustrates a bottom view of an exemplary embodiment of a magazine release button member, according to the present disclosure.
Figure 52:
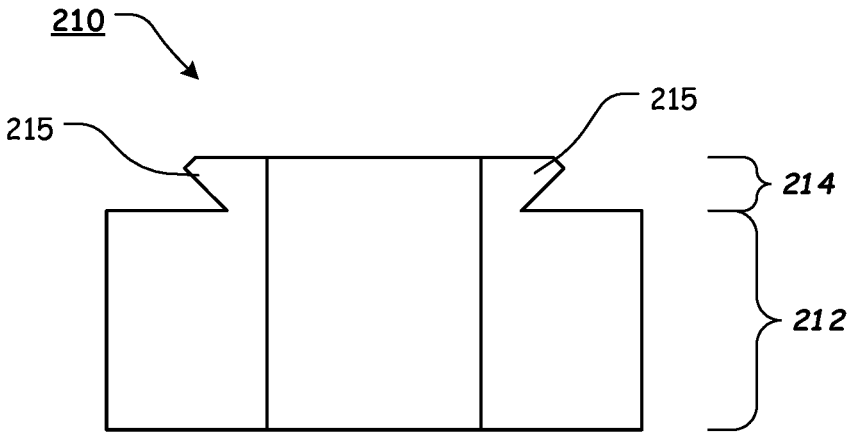
FIG. 52 illustrates a front side view of an exemplary embodiment of a magazine release button member, according to the present disclosure.
Figure 53:
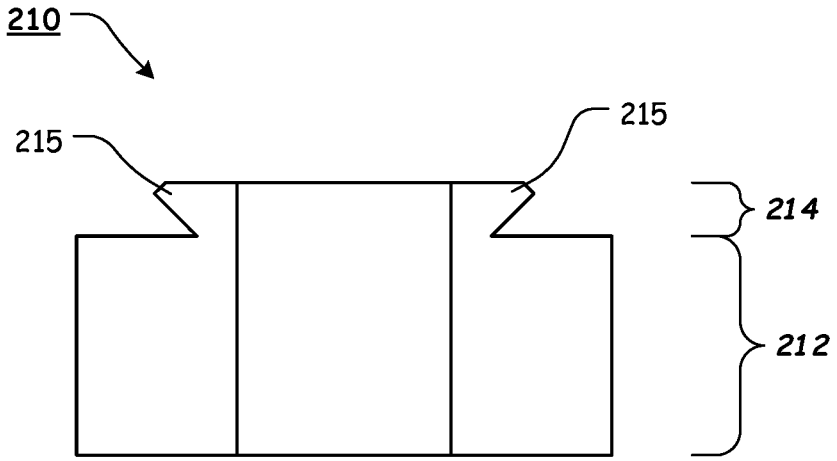
FIG. 53 illustrates a rear side view of an exemplary embodiment of a magazine release button member, according to the present disclosure.
Figure 54:
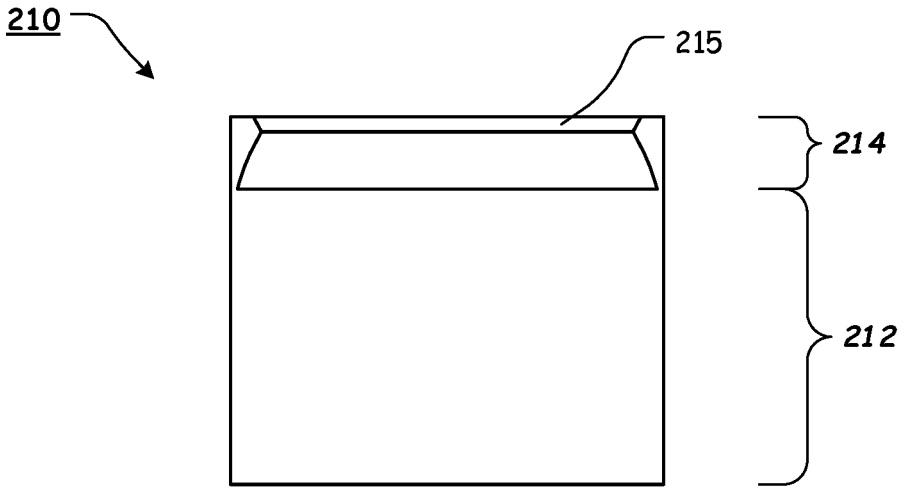
FIG. 54 illustrates a right side view of an exemplary embodiment of a magazine release button member, according to the present disclosure.
Figure 55:
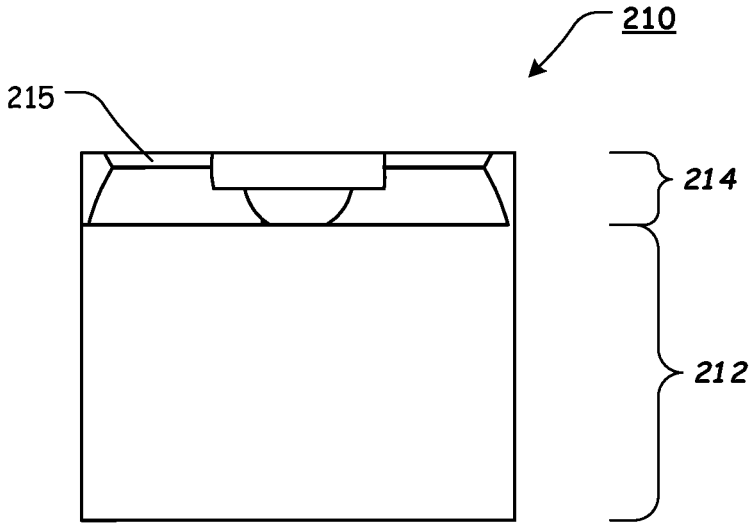
FIG. 55 illustrates a left side view of an exemplary embodiment of a magazine release button member, according to the present disclosure.
Figure 56:
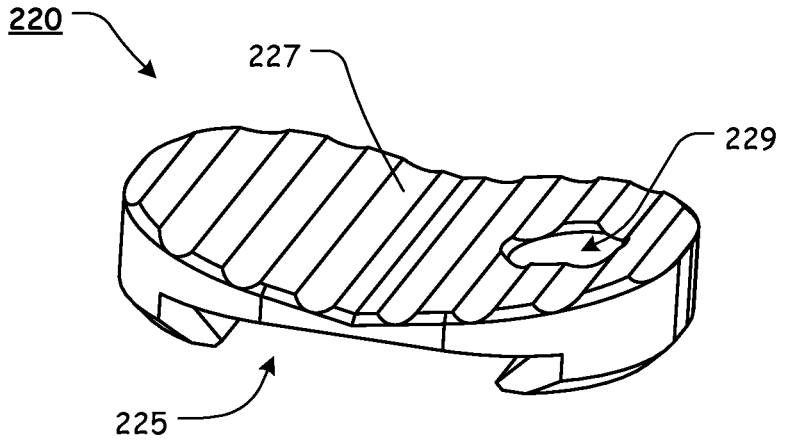
FIG. 56 illustrates a first, upper, perspective view of an exemplary embodiment of a magazine release button assembly finger pad, according to the present disclosure.
Figure 57:
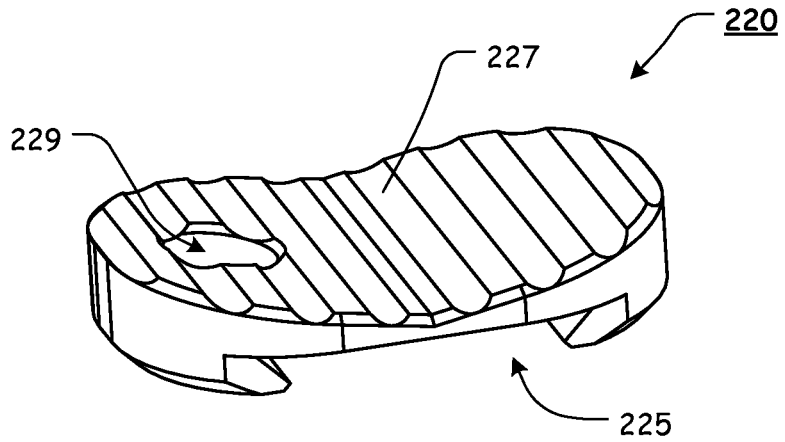
FIG. 57 illustrates a second, upper, perspective view of an exemplary embodiment of a magazine release button assembly finger pad, according to the present disclosure.
Figure 58:
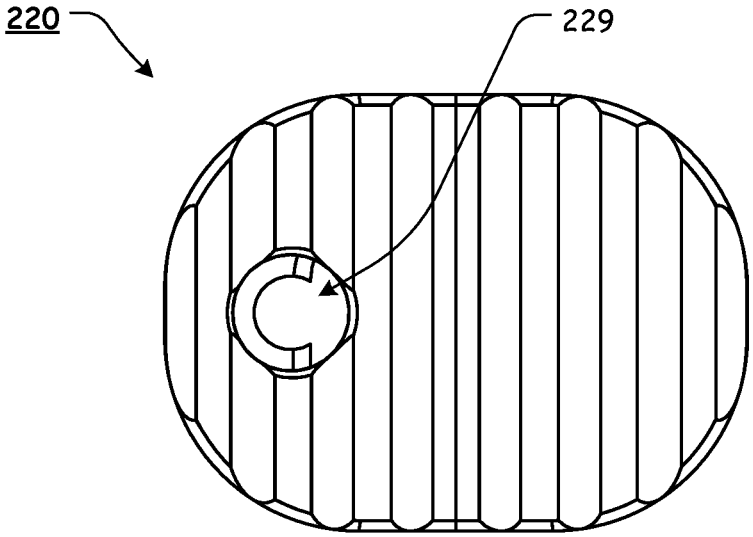
FIG. 58 illustrates a top view of an exemplary embodiment of a magazine release button assembly finger pad, according to the present disclosure.
Figure 59:
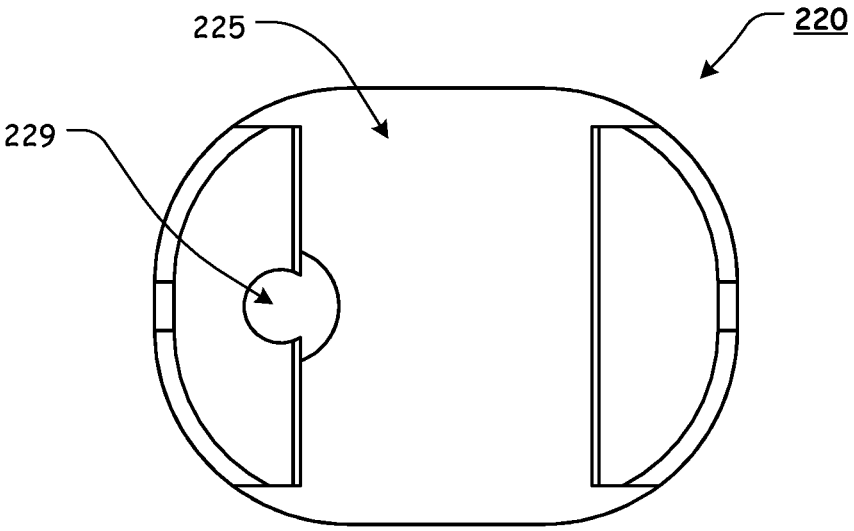
FIG. 59 illustrates a bottom view of an exemplary embodiment of a magazine release button assembly finger pad, according to the present disclosure.
Figure 60:
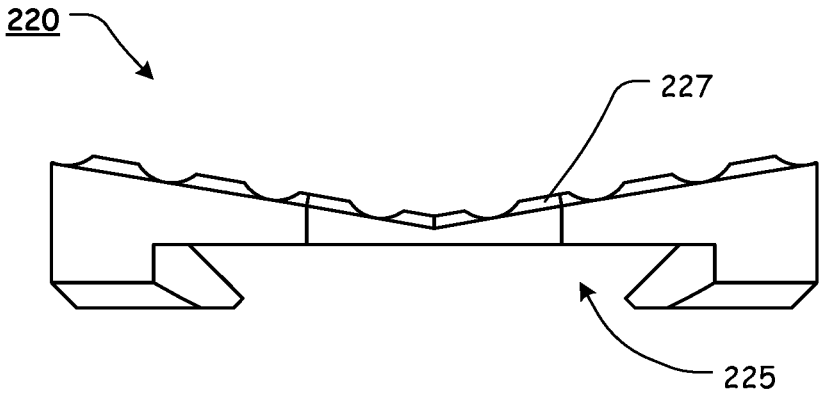
FIG. 60 illustrates a front side view of an exemplary embodiment of a magazine release button assembly finger pad, according to the present disclosure.
Figure 61:
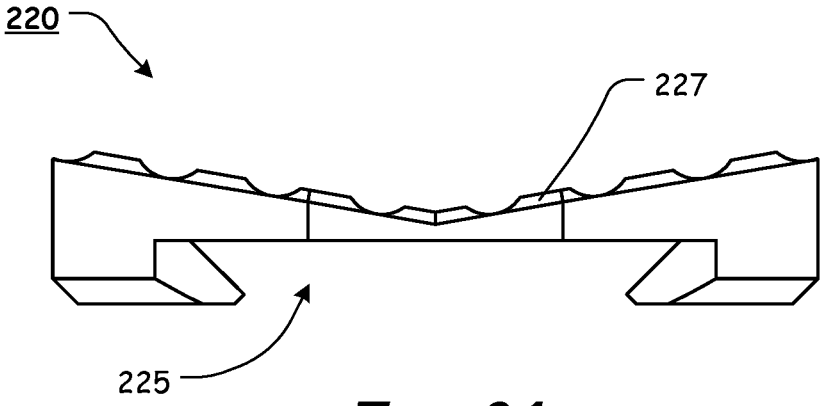
FIG. 61 illustrates a rear side view of an exemplary embodiment of a magazine release button assembly finger pad, according to the present disclosure.
Figure 62:
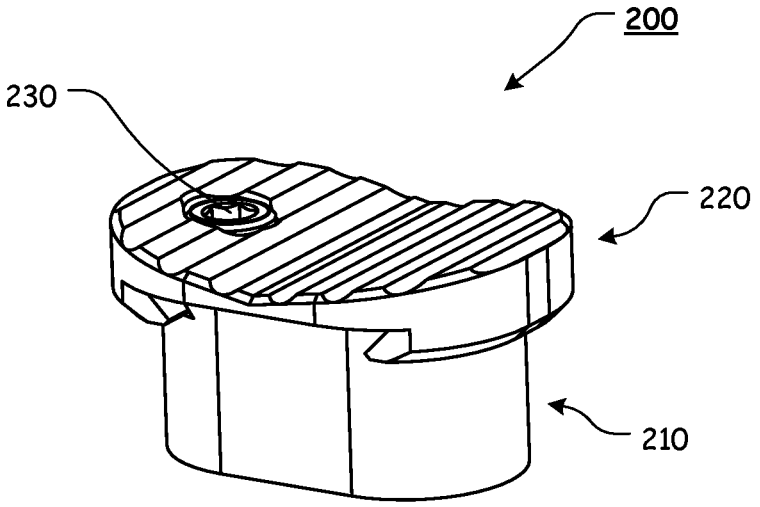
FIG. 62 illustrates an upper, perspective view of an exemplary embodiment of a magazine release button assembly, according to the present disclosure.
Figure 63:
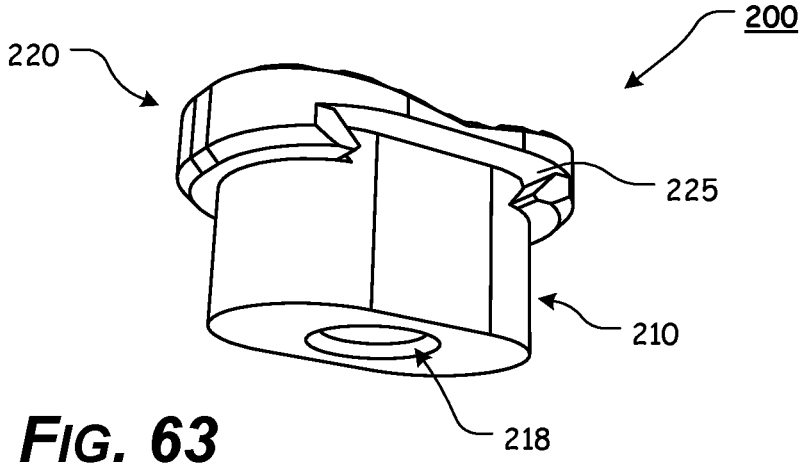
FIG. 63 illustrates a lower, perspective view of an exemplary embodiment of a magazine release button assembly, according to the present disclosure.

In certain exemplary embodiments, as illustrated, for example, in FIGS. 47, 50, and 62, the fastener 230 comprises a screw and the secondary aperture 219 comprises a threaded or at least partially threaded aperture. It should be appreciated that in other exemplary embodiments, the fastener 230 may comprise, for example, a roll pin and the secondary aperture 219 may comprise a non-threaded aperture sized so as to receive and be frictionally engaged with the roll pin.

Figure 64:
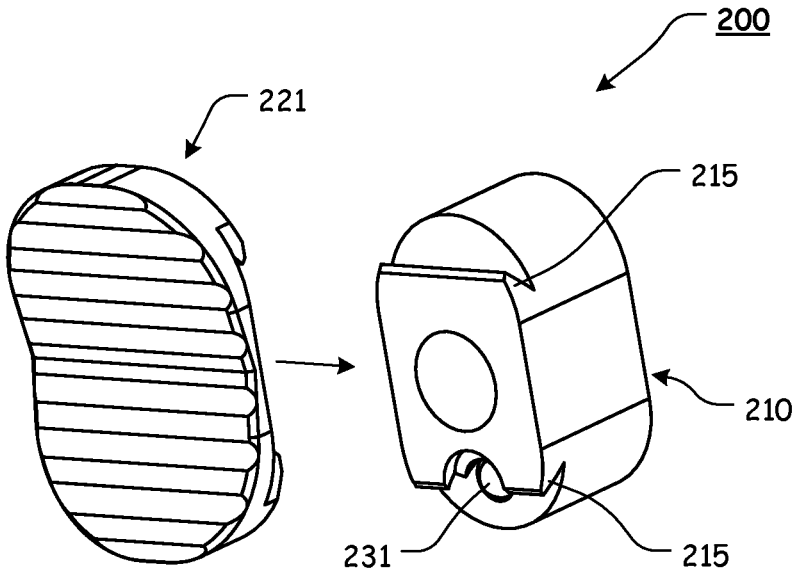
FIG. 64 illustrates an exploded view showing the components of an alternate exemplary embodiment of a magazine release button assembly, according to the present disclosure.
Figure 65:
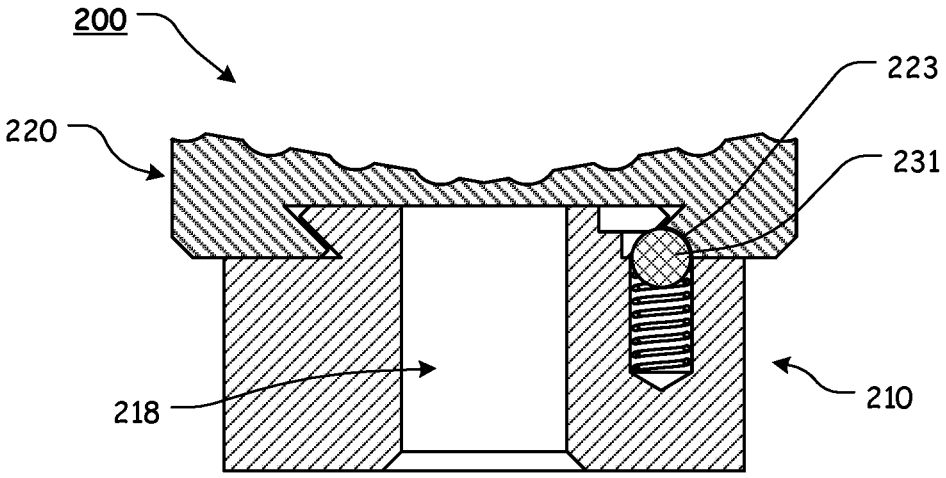
FIG. 65 illustrates cross-sectional view showing the components of the exemplary embodiment of the magazine release button assembly illustrated in FIG. 64, according to the present disclosure.

In certain exemplary embodiments, as illustrated, for example, in FIGS. 64 and 65, the secondary aperture 219 includes a captured, spring biased ball 231 and the finger pad member aperture 229 is replaced by a ball detent cavity 123.

In these exemplary embodiments, as the finger pad member 220 is slidably attached to the button member 210, the spring bias of the spring biased ball 231 is overcome and the spring biased ball 231 is urged at least partially into the secondary aperture 219, to allow the finger pad member 220 to be slidably positioned relative to the button member 210. When the finger pad member 220 is in a determined, attached position, the spring bias of the spring biased ball 231 urges at least a portion of the spring biased ball 231 from at least a portion of the secondary aperture 219 to interact with and be at least partially captured within a portion of the ball detent cavity 123 to maintain the finger pad member 220 in a desired position relative to the button member 210.

It should be understood that in these exemplary embodiments, the fastener 230 comprises the spring biased ball 231, which interacts with the ball detent cavity 123. Thus, the finger pad member aperture 229 is removed and the face of the finger pad member 220 does not include an aperture formed therein.

As further illustrated, the finger pad member 220 includes a recess 225 mateable with the projection 215 of the button member 210. Thus, when assembled, the finger pad member 220 is slidably secured proximate the end of the button member 210 via interaction of the projection 215 and the recess 225.

In various exemplary embodiments, as illustrated, the finger pad member 220 is optionally further secured to the projection portion 214 by suitable means, such as, for example, a fastener 230 or a spring biased ball 231. The recessed design of the present disclosure provides a very solid attachment in which the fastener 230 or the spring biased ball 231 simply provide an additional element to prevent the finger pad member 220 from unintentionally sliding along the recesses 225.

The button member 210 includes at least one projection 215 formed in the projection portion 214 of the button member 210 and the finger pad member 220 is formed with recess 225, which is optionally slidable or otherwise mateable with the projection 215. In various exemplary embodiments, the projection 215 is a dovetail projection 215 and the recess 225 in the finger pad member 220 is a mating, dovetailed recess 225. More specifically, the illustrated projection 215 is a 2-sided dovetail projection 215 and the recess 225 in the finger pad member 220 is a 2-sided dovetailed recess 225. In various exemplary embodiments, the projection 215 comprises a 2-sided dovetail projection, wherein the dovetail projections are on opposing sides of the projection portion 214, relative to one another. In these embodiments, the recess 225 comprises a mating, 2-sided dovetail recess that extends or traverses the finger pad member 220, from one side of the finger pad member 220 to an opposing or opposite side of the finger pad member 220.

In embodiments wherein the finger pad member 220 further comprises a finger pad member aperture 229 formed therethrough. When the finger pad member 220 is appropriately secured to the button member 210, the finger pad member aperture 229 aligns with the secondary aperture 219, such that the fastener 230 can be secured through the finger pad member aperture 229 and the secondary aperture 219. In embodiments wherein the finger pad member comprises a spring biased ball 231, when the finger pad member 220 is appropriately secured to the button member 210, the ball detent cavity 123 aligns with the secondary aperture 219 (and the spring biased ball 231), such that the spring biased ball 231 can be at least partially captured within the ball detent 223.

In certain exemplary embodiments, the finger pad member 220 has a generally "U", "V", or surface 227 formed with a plurality of parallel grooves. These grooves, if included, serve to prevent the user's finger from slipping off the finger pad member 220. In various exemplary, nonlimiting embodiments, the finger pad member 220 comprises a textured surface 227. In certain exemplary embodiments, the surface 227 may be textured or non-textured and may be substantially concave. Alternatively, the surface 227 may be textured or non-textured and may be substantially flat. In still other alternative embodiments, the surface 227 may be textured or non-textured and may be substantially convex. Thus, it should be appreciated that the surface 227 may be textured or non-textured and may be substantially flat, concave, or convex, based upon the desired appearance and/or functionality of the finger pad member 220.

In various exemplary embodiments, the surface 227 is concave and the concavity of the surface 227 is parallel to the boar axis of the firearm. In this manner, the surface 227 acts to "self-center" the user's finger on the center of the finger pad member 220, thereby limiting lateral movement of the user's finger (up-and-down relative to the side wall of the firearm 20) and centering pressure from the user's finger on the center of the finger pad member 220.

In various exemplary, nonlimiting embodiments, the present disclosure optionally provides a plurality of interchangeable finger pad members 220 of different lengths, widths, thicknesses, configurations, profiles, and/or surface preparations to allow a user to select a finger pad member 220 that is most satisfactory to the shooter. It should be appreciated that, based upon the modularity of the present disclosure, finger pad members 220 may be exchanged or interchanged as desired, without having to remove the button member 210 from the firearm.

For example, a taller finger pad member may even extend above the ridge that typically extends from the receiver of the firearm to protect the magazine release button from inadvertent manipulation. This taller finger pad member 220 may be utilized by users competing in, for example, three gun matches who prefer to be able to "slap" the magazine release button and release the magazine without concern about having a low-profile magazine release button.

In various exemplary embodiments, various components of the magazine release button assembly 200 are substantially rigid and are formed of aluminum. Alternate materials of construction of the various components of the magazine release button assembly 200 may include one or more of the following: steel, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the magazine release button assembly 200 is a design choice based on the desired appearance and functionality of the magazine release button assembly 200.

It should be appreciated that certain elements of the magazine release button assembly 200 may be formed as an integral unit (such as, for example, the button member 210 and the finger pad member 220).

Alternatively, suitable materials can be used and sections or elements made independently and attached or coupled together, such as by adhesives, welding, screws, rivets, pins, or other fasteners, to form the various elements of the magazine release button assembly 200.

It should also be understood that the overall size and shape of the magazine release button assembly 200 and the various portions thereof, the button member 210, and the finger pad members 220, is a design choice based upon the desired functionality and/or appearance of the magazine release button assembly 200.

It should also be appreciated that a more detailed explanation of the instructions regarding how to install the button member 210 of the magazine release button assembly 200 are not provided herein because such background information will be known to one of ordinary skill in the art. Therefore, it is believed that the level of description provided herein is sufficient to enable one of ordinary skill in the art to understand and practice the present disclosure, as described.

Figure 66:
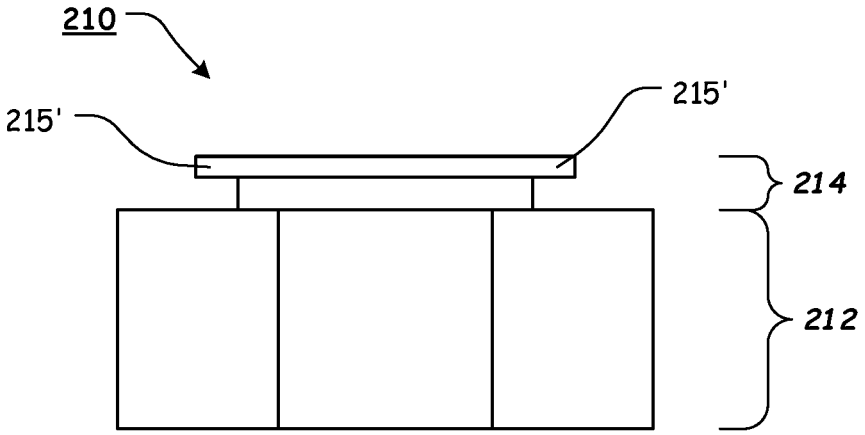
FIG. 66 illustrates a front side view of an exemplary embodiment of a magazine release button assembly, according to the present disclosure.
Figure 67:
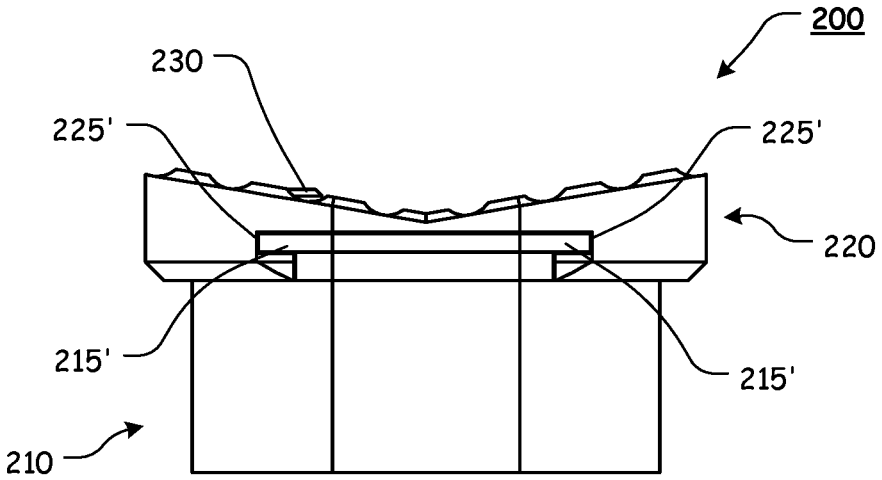
FIG. 67 illustrates a front view of an exemplary embodiment of a magazine release button assembly, according to the present disclosure.

FIGS. 66-67 illustrate an exemplary embodiment of a button member 210 and a finger pad member 220. As illustrated, the button member 210 has a projection 215' formed in the projection portion 214 of the button member 210 and the finger pad member 220 is formed with recess 225', which mates with the projection 215'. The projection 215' is a "T" or square-shaped projection 215' and the recess 225' in the finger pad member 220 is a mating, "T" or square-shaped recess 225'. More specifically, the illustrated projection 215' is a 2-sided "T" or square-shaped projection 215' and the recess 225' in the finger pad member 220 is a 2-sided "T" or square-shaped recess 225'.

Because of the interlocking characteristics of the projection 215 or 215' and the recess 225 or 225', the tendency of the finger pad member 220 or 220' to rotate or cam during manipulation is overcome. Thus, the tendency to rotate or cam and the torque created by such motion is overcome with or without use of the fastener 230.

Figure 68:
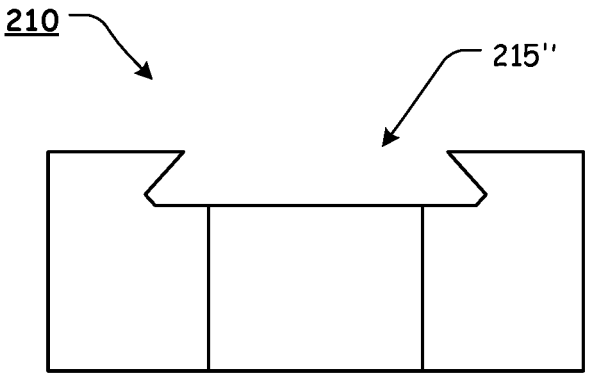
FIG. 68 illustrates a front side view of an exemplary embodiment of a magazine release button member (the rear side view being a mirror image thereof), according to the present disclosure.
Figure 69:
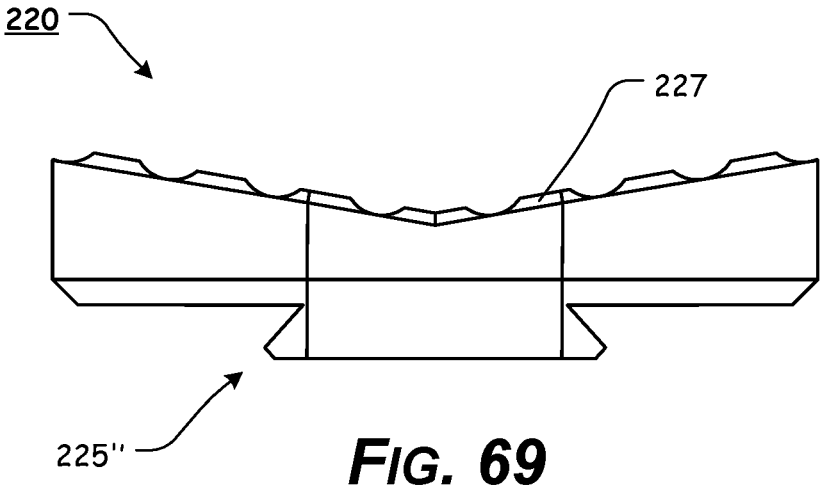
FIG. 69 illustrates a front side view of an exemplary embodiment of a magazine release button assembly finger pad (the rear side view being a mirror image thereof), according to the present disclosure.

FIGS. 68-69 illustrate an exemplary embodiment of a button member 210 and a finger pad member 220. As illustrated, the button member 210 has a recess 215" formed in the button member 210 and the finger pad member 220 includes a projection 225", which is mateable with the recess 215". It should be appreciated that while the recess 215" is illustrated as being a substantially dovetailed recess 215" and the projection 225" is illustrated as being a substantially dovetail shaped projection 225", the recess 215" and the projection 225" may be any desirable, mating shapes, including, for example, a "T" or square-shaped projection 215" and recess 225".

While the present disclosure has been described in conjunction with the exemplary embodiments outlined above, the foregoing description of exemplary embodiments of the present disclosure, as set forth above, are intended to be illustrative, not limiting and the fundamental disclosure should not be considered to be necessarily so constrained. It is evident that the present disclosure is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A magazine release button assembly for a firearm, comprising:

a button member, wherein said button member includes a projection extending from an end of said button member, wherein said projection comprises a dovetail projection, wherein a secondary aperture is formed at least partially through said button member, and wherein said secondary aperture comprises a spring biased ball; and a finger pad member, wherein said finger pad member includes a recess, wherein said recess comprises a dovetail recess, wherein said dovetail recess is mateable with said dovetail projection of said button member, wherein said finger pad member includes a ball detent cavity, wherein said finger pad member is secured to said end of said button member via interaction of said dovetail projection and said dovetail recess, wherein said finger pad member is further secured to said end of said button member via at least partial interaction of said spring biased ball and said ball detent cavity.

2. The magazine release button assembly of claim 1, further comprising a primary threaded aperture formed through said button member, parallel to said longitudinal axis of said button member, wherein said primary threaded aperture is formed so as to interact with a threaded portion of a magazine release.

3. The magazine release button assembly of claim 2, wherein said secondary aperture is formed at a distance spaced apart from said primary threaded aperture, and wherein said secondary aperture is formed parallel to said longitudinal axis of said button member.

4. The magazine release button assembly of claim 1, wherein said button member is shaped so as to resist rotational movement and allow at least some movement along a longitudinal axis of said button member.

5. The magazine release button assembly of claim 1, wherein said finger pad member comprises a substantially concave, flat, or convex surface.

6. The magazine release button assembly of claim 1, wherein a plurality of parallel grooves are formed on a surface of said finger pad member.

7. The magazine release button assembly of claim 1, wherein a plurality of interchangeable finger pad members are provided.

8. The magazine release button assembly of claim 1, wherein said dovetail projection is a 2-sided dovetail projection.

9. The magazine release button assembly of claim 1, wherein said dovetail projection is a 3-sided dovetail projection.

10. The magazine release button assembly of claim 1, wherein said dovetail recess is a 2-sided dovetail recess.

11. The magazine release button assembly of claim 1, wherein said dovetail recess is a 3-sided dovetail recess.

* * * * *